US006339443B1

(12) United States Patent
Nakanishi et al.

(10) Patent No.: US 6,339,443 B1
(45) Date of Patent: Jan. 15, 2002

(54) THERMAL HEAD, THERMAL PRINTER AND THERMAL PRINTING METHOD

(75) Inventors: Kanji Nakanishi, Saitama; Noboru Komori, Kanagawa; Tomoyoshi Nishimura, Saitama, all of (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/008,065

(22) Filed: Jan. 16, 1998

(30) Foreign Application Priority Data

| | | |
|---|---|---|
| Jan. 16, 1997 | (JP) | 9-005824 |
| Mar. 26, 1997 | (JP) | 9-073030 |
| Jul. 10, 1997 | (JP) | 9-184918 |
| Dec. 4, 1997 | (JP) | 9-334393 |

(51) Int. Cl.[7] ..... B41J 2/335
(52) U.S. Cl. ..... 347/200
(58) Field of Search ..... 347/200, 202

(56) References Cited

U.S. PATENT DOCUMENTS

| | | | | |
|---|---|---|---|---|
| 5,179,391 A | | 1/1993 | Miyazaki | 346/76 |
| 5,745,151 A | * | 4/1998 | Fujishiro | 347/175 |

FOREIGN PATENT DOCUMENTS

| | | | | |
|---|---|---|---|---|
| JP | 61-10470 | * | 1/1986 | 347/200 |
| JP | 2-136249 | * | 5/1990 | 347/200 |
| JP | 2-215569 | | 8/1990 | B41J/29/00 |
| JP | 2-233281 | | 9/1990 | B41J/29/00 |
| JP | 61-10469 | * | 1/1998 | 347/200 |

* cited by examiner

*Primary Examiner*—Huan Tran
(74) *Attorney, Agent, or Firm*—Sughrue Mion, PLLC

(57) ABSTRACT

A thermal printer includes a conveyor for conveying thermosensitive recording material in a predetermined conveying direction. A thermal head applies heat to the recording material being conveyed, to record an image to the recording material. The thermal head incorporates plural heating elements, which are arranged in an array crosswise to the conveying direction, and generate the heat. The thermal head includes a contact region predetermined for pressing the recording material. A center of the contact region is positioned downstream from a center of the heating elements with reference to the conveying direction.

40 Claims, 20 Drawing Sheets

THERMAL HEAD, THERMAL PRINTER AND THERMAL PRINTING METHOD

BACKGROUND OF THE INVENTION

1. Field of the Invention

The present invention relates to a thermal head, a thermal printer and a thermal printing method. More particularly, the present invention relates to a thermal head, a thermal printer and a thermal printing method in which surface gloss of recording material is prevented from being lowered after the printing operation at the thermal head.

2. Description Related to the Prior Art

In a color direct thermal recording method of an optical fixation type, a color thermosensitive recording material is used, and includes yellow (Y), magenta (M) and cyan (C) coloring layers overlaid one on another. The coloring layers are heated to develop colors, to record a full-color image. Each of the coloring layers includes micro capsules, coupler and binder. The micro capsules have a sub-micron size, and include a diazonium salt compound as precursor of azo dye as a coloring substance. The coupler and the binder quicken the color development of the micro capsules. In the color development, each coloring layer is heated by a thermal head, to change partitions between the micro capsules to the light-transmitting state, so that the coupler is introduced to the micro capsules to develop the color. In the heating for the magenta, the yellow is prevented from being colored. In the heating for the cyan, the magenta is prevented from being colored. For this prevention, the precursor of the coloring substance of each color is decomposed by application of ultraviolet rays, near ultraviolet rays or visible violet rays, so that each upper coloring layer is kept from being further colored while a coloring layer being next underlaid is heated with relative high heat energy.

In FIG. 25, curves of coloring characteristics of the recording material are illustrated in a graph. The curves represent relationships between coloring density of each of the coloring layers and coloring heat energy generated by heating elements while the thermal head is pressed against the recording material. As is understood from the graph, it is necessary in the color direct thermal recording to use the dynamic range of the coloring heat energy without overlapping between three coloring layers disposed to lie in respective depths in the recording material. If it is desired to set the thermosensitivity of the coloring layers nearly equal to that of other printing methods such as thermal wax transfer printing, then it is required to set a range of the coloring heat energy three times as great as a range of the coloring heat energy according to the thermal wax transfer method. However a range of the coloring heat energy for the three colors is actually set 1.5 or less times as great as a range of the coloring heat energy according to the thermal wax transfer method. This is due to limited heat resistance of the recording material.

Ink ribbon used in the thermal wax transfer method as recording material is discarded after the printing operation. It is possible to construct the ink ribbon only in view of high suitability to thermal printing without considering its final appearance after the printing operation. In contrast final appearance of the recording material for the color direct thermal recording is important after the printing operation, because the recording material should become a print as a finished product in a manner similar to an image receiving sheet used in the thermal wax transfer method. Consequently the recording material must have sufficiently high rigidity and heat capacity. In general it is difficult to contact the recording material being rigid and including paper in a state of readily conducting heat. As is known in the art, the color direct thermal recording requires heat control with higher precision than other thermal printing methods. Furthermore, the color direct thermal recording is associated with a heat contacting condition more difficult than that of other thermal printing methods. It follows in the color direct thermal recording that more stable heat contact should be effected than other thermal printing methods.

In the printer of the color direct thermal recording, the thermal head having partial glaze formed locally in a ridge-shape is used to stabilize heat contact between the thermal head and the recording material, for the purpose of strengthen a head touch of the recording material. The heating elements of the thermal head are arranged on the partial glaze to heighten pressure in the contact by pressing the recording material by a platen roller. The thermal head known in the prior art has the heating elements of which the center is positioned at the top of protruded shape of the partial glaze. Disposition of the platen roller, a pressing condition and a material conveying condition are determined in consideration of stabilized contacting condition of the recording material with the thermal head.

Irrespective of states in which the recording material is pressed against the protruding portion of the partial glaze by the platen roller, there is tension applied to the recording material in a system where a pair of conveyor rollers convey the recording material by drawing it from between the thermal head and the platen roller. In a range downstream from the top of the partial glaze in the conveying direction of the recording material, the tension causes a downstream portion of the recording material to come away from the partial glaze. It is likely that the contacting condition between the recording material and the heating elements at the glaze top is influenced by changes in the tension, irregularity in rotation of the platen roller, and changes in pressure. The contacting state becomes unstable, to change coloring density in an unstable manner.

The type of the recording material is a direct recording medium, of which its recording surface directly heated by the thermal head at high temperature becomes a finally image-reproducing surface. Influence of heat application remains on the surface of the obtained print in a conspicuous manner in comparison with thermal printing with the ink ribbon or the like. Among the coloring layers, the coloring heat energy of the highest value is required to color the cyan coloring layer underlying the lowest of the three. If the cyan is colored at its maximum density, the thermal head becomes as hot as 200 degrees centigrade. If the recording material comes away from the thermal head immediately after passage of the heating elements, the pressure to the recording material abruptly comes down despite the state of the high temperature of the surface and the inside of the recording material. Gas is likely to occur inside the recording material to create blisters or bubbles. The surface of the recording material is likely to be roughened. The surface gloss of the recording material will be lowered.

In any of known methods, it is impossible in the color direct thermal recording to discharge heat from the recording material after passing the recording material. In the range downstream from the top of the partial glaze and upstream from a sheet outlet of the printer, the contact between the thermal head and the recording material is unstable. No good gloss on the recording material is obtainable.

There are various smoothing methods as disclosed in JP-A 2-215569, JP-A 2-233281 and U.S. Pat. No. 5,179,391

(corresponding to JP-A 3-21460), in which the recording material provided with minute protrusions and recesses on its surface is smoothed in a post-process to heighten its gloss. However those require an additional device and additional material for the post-process of glossing separately succeeding to the thermal printing process. The post-process requires manual operation, to complicate the operation of the entirety to a somewhat great extent. It is certain that the device for the post-process could be incorporated in a thermal printer. However the printer thus constructed would be excessively large and expensive.

SUMMARY OF THE INVENTION

In view of the foregoing problems, an object of the present invention is to provide a thermal head, a thermal printer and a thermal printing method in which surface gloss of recording material is prevented from being lowered after the printing operation at the thermal head.

Another object of the present invention is to provide a thermal head, a thermal printer and a thermal printing method in which surface irregularity is prevented on recording material from occurring after the printing operation at the thermal head.

In order to achieve the above and other objects and advantages of this invention, a thermal printer includes a conveyor for conveying thermosensitive recording material in a predetermined conveying direction. A thermal head applies heat to the recording material being conveyed, to record an image to the recording material. The thermal head incorporates plural heating elements, arranged in an array crosswise to the conveying direction, for generating the heat. The thermal head includes a contact region predetermined for pressing the recording material, a center of the contact region being positioned down stream from a center of the heating elements with reference to the conveying direction.

The contact region includes a heating surface, disposed on an outside of the heating elements, for conducting the heat to the recording material. A cooling surface is disposed downstream adjacent to the heating surface in the conveying direction, for cooling the recording material.

A platen member is disposed opposite to the thermal head, for supporting a back of the recording material pressed by the thermal head.

The contact region further includes a pre-contact surface disposed upstream adjacent to the heating surface in the conveying direction, and the thermal head satisfies a condition of:

$$LCRL > UCRL$$

where UCRL is a length of the pre-contact surface with reference to the conveying direction, and LCRL is a length of the cooling surface with reference to the conveying direction.

The platen member is disposed upstream offset from the center of the heating elements in the conveying direction.

The thermal head includes a base plate. A partial glaze is disposed to project from the base plate in a ridge shape with smooth convexity, the heating elements being arranged on the partial glaze, the partial glaze pressing the recording material. The heating elements are disposed upstream offset from a center of the partial glaze in the conveying direction.

In another preferred embodiment, the platen member is disposed upstream offset from a center of the partial glaze in the conveying direction.

In still another preferred embodiment, a rise surface is disposed between the heating surface and an upstream distal end of the partial glaze with reference to the conveying direction, and at least partially curved at a first radius of curvature. The cooling surface is flat or curved at a predetermined radius of curvature, the predetermined radius being greater than the first radius.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
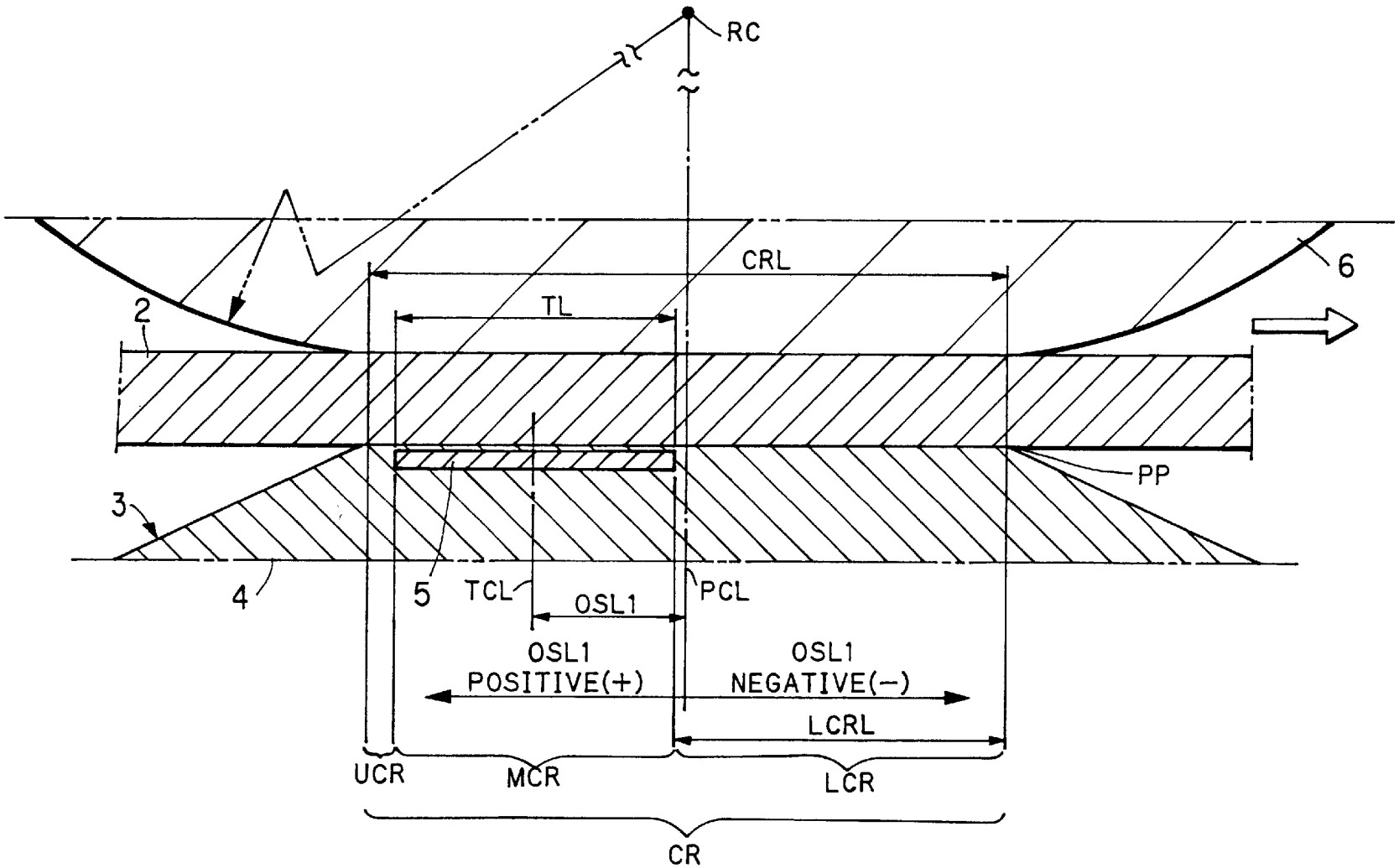
FIG. 1 is a cross section illustrating an arrangement of a thermal head, thermosensitive recording material and a platen roller.

FIG. 1 illustrates a model of a relationship of a thermal head and a thermosensitive recording material as considered experimentally in thermal analysis according to the finite element method. A thermosensitive recording material 2 is placed on a heating element array 3 or ridge-shaped head component. The ridge-shaped head component 3 includes a partial glaze 4 and plural heating elements 5 arranged on the partial glaze 4. In the experimental model, the heating elements 5 have a length TL=220 μm as viewed in a material conveying direction being horizontal. The thermal head is constructed to contact the recording material 2 in a range of a contact region CR, which has a contact region length CRL=500 μm as viewed in the conveying direction. Let RC be a roller center of a platen roller 6. Let PCL be a center or vertical center line on which the roller center RC lies. Let TCL be a heating element center or vertical center line on which a center of the heating elements 5 lies. Let OSL1 be an offset distance between the center PCL and the heating element center TCL. In simulation, the offset distance OSL1 was set at values of 120 μm, 60 μm, 0 μm, −60 μm and −120 μm. Thermal changes of a cyan coloring layer of the recording material 2 were calculated assuming that the cyan coloring layer is heated with exactly sufficient heat for cyan maximum density. Note that, with the offset distance OSL1, the positive sign "+" means an upstream side in the conveying direction. The negative sign "−" means a downstream side in the conveying direction. In the drawing, the arrow indicates the conveying direction of the recording material 2.

Figure 25:
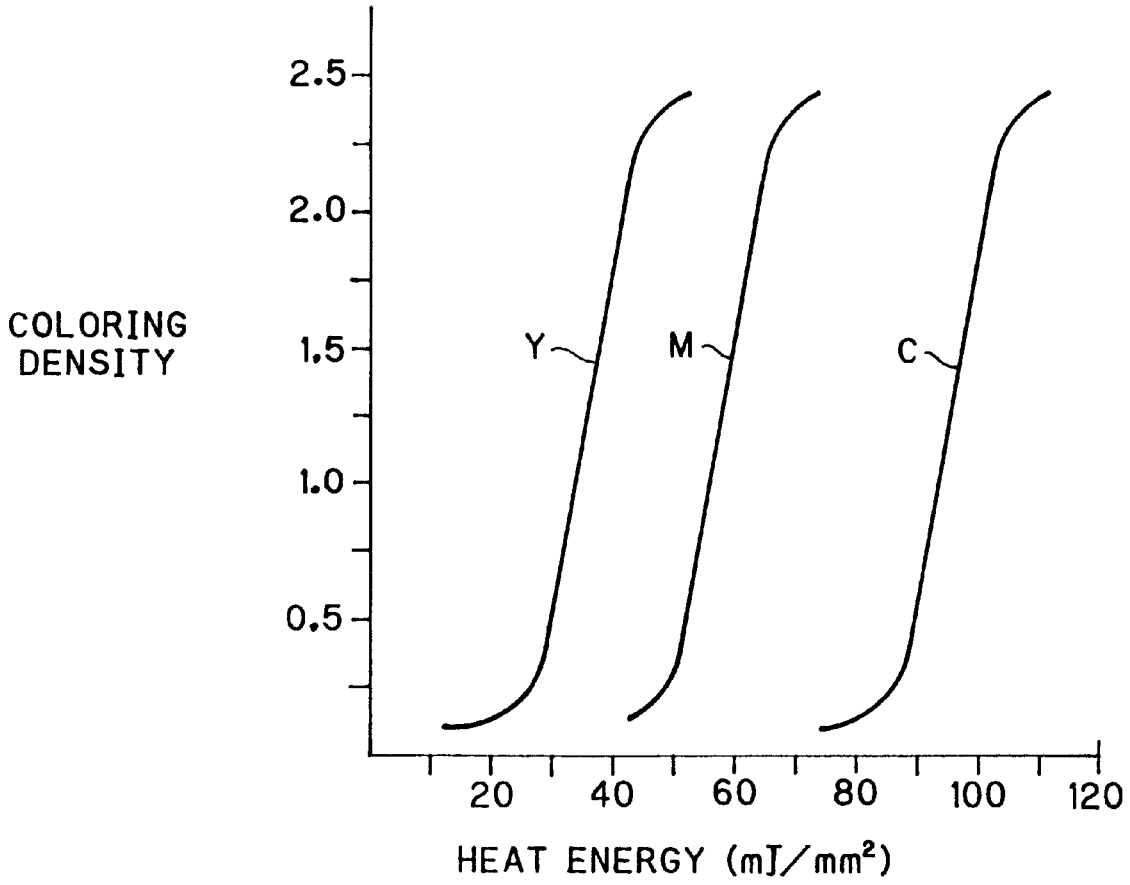
FIG. 25 is a graph illustrating curves of coloring characteristics of the recording material.

For characteristics of the recording material 2, see FIG. 25. The recording material 2 has a layer structure in FIG. 1A, and includes a support 2*a,* a cyan coloring layer 2*b,* a magenta coloring layer 2*c,* a yellow coloring layer 2*d,* and a protective layer 2*e.*

Simulation of the printing was conditioned as follows:

Recording material: A4-G50 (trade name) manufactured by Fuji Photo Film Co., Ltd.

Thermal printer: NC-501 (trade name) manufactured by Fuji Photo Film Co., Ltd.

Printing speed: 10 mm/sec.

Period of powering: 10 msec.

Duration of powering: 6 msec.

Electric power: 0.11 W per one dot.

Figure 2:
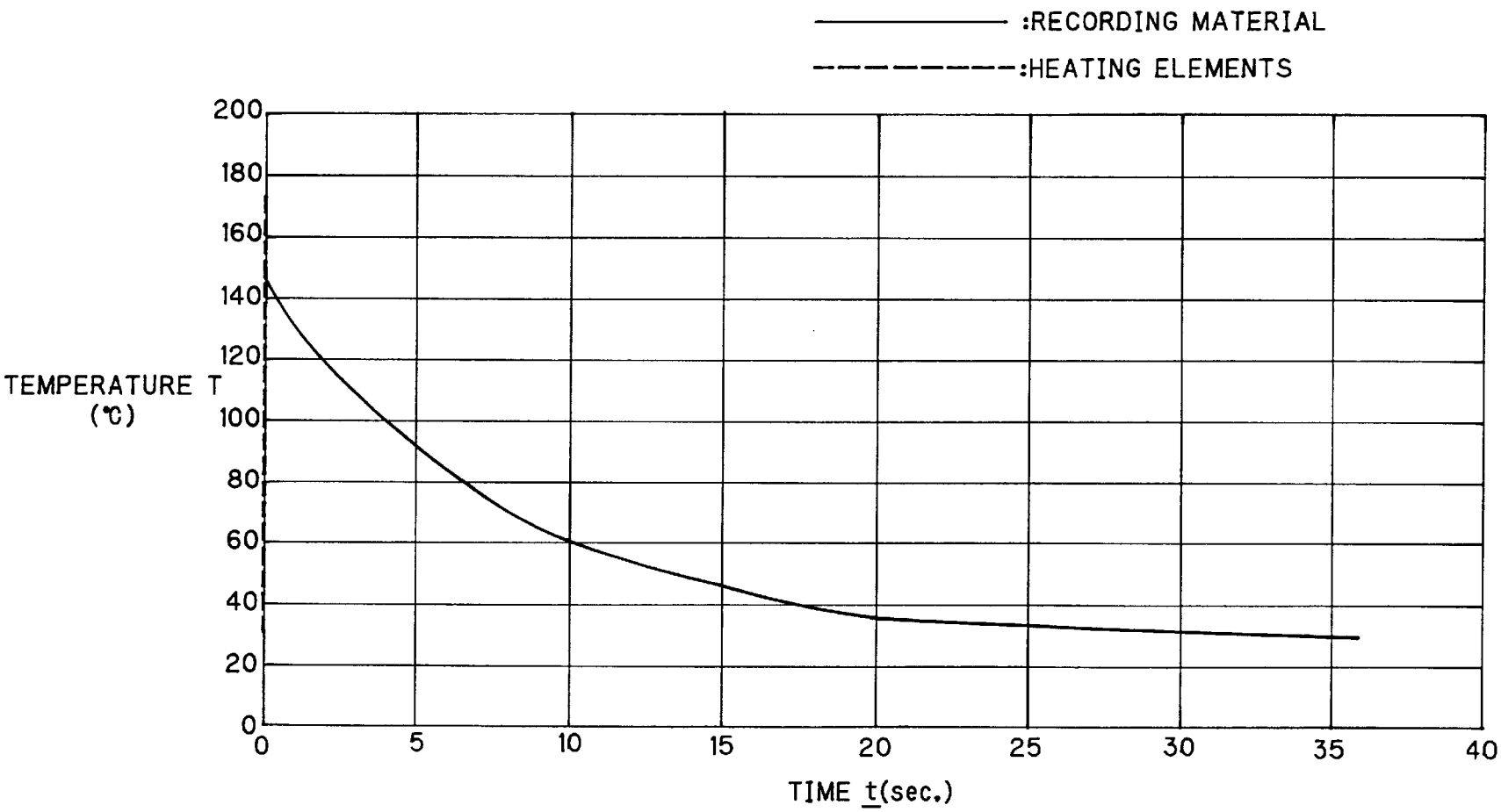
FIG. 2 is a graph illustrating changes in temperature of the recording material and heating elements with time.
Figure 3:
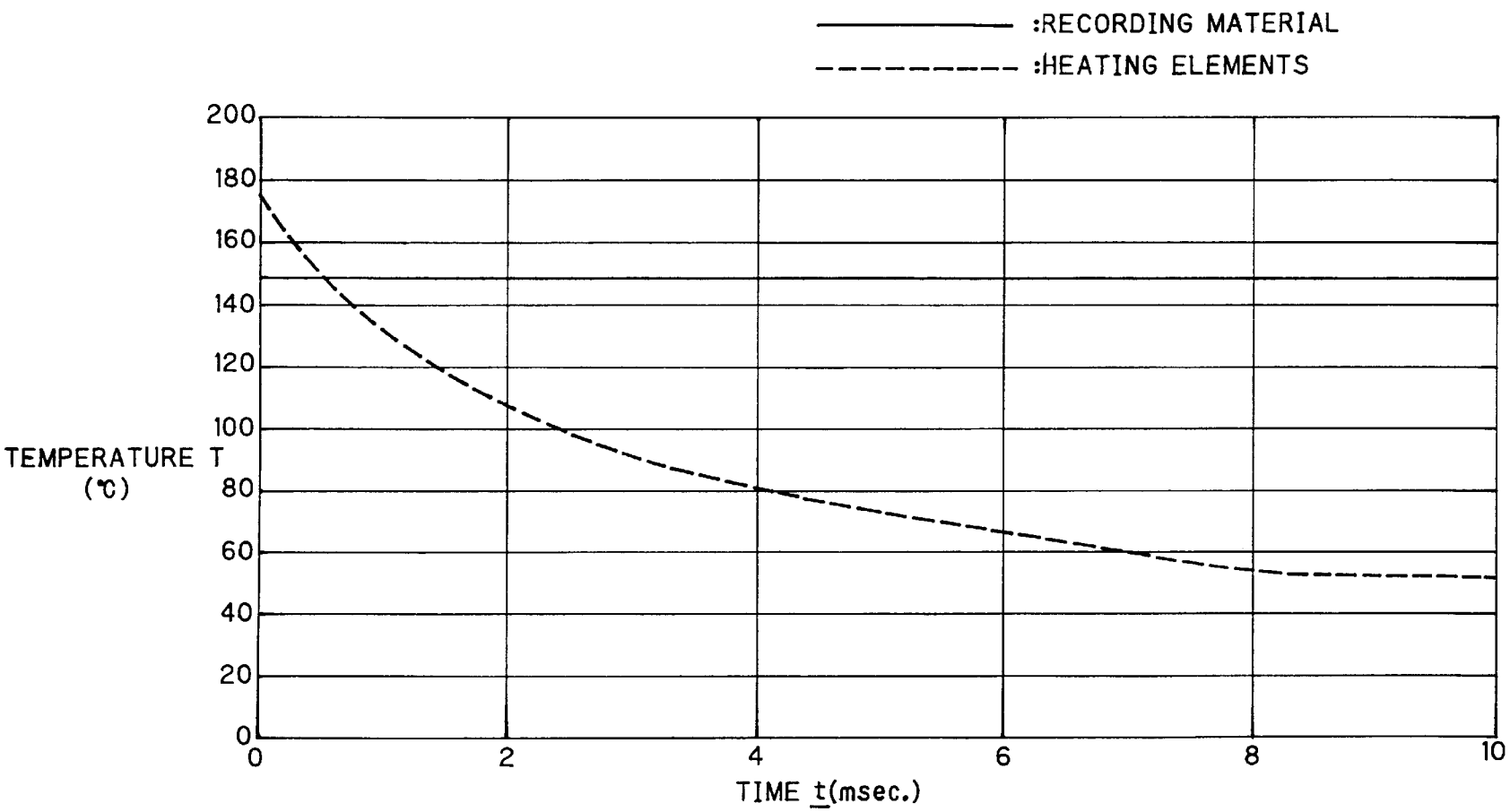
FIG. 3 is a graph illustrating the same as FIG. 2 but in enlargement in the axial direction of the time.

FIGS. 2 and 3 illustrate characteristics of cooling of the recording material and the thermal head conditioned as described above. In both of FIGS. 2 and 3, a horizontal axis is taken for time, and a vertical axis is taken for temperature in centigrade. Changes in the temperature with reference to the time in the course of the cooling are indicated for both the recording material and the thermal head. As the speed in the change of the temperature is extremely different between the recording material and the thermal head, it is difficult in a single drawing to depict two curves in an apparently curved manner. In FIG. 2, the time on the horizontal axis is expressed in seconds. In FIG. 3, the time on the horizontal axis is expressed in milliseconds or msec. Room temperature was 27° C. The thermal head is constructed with extremely rapid changeability in temperature, and is cooled down to the room temperature even after 10 milliseconds. In contrast, the recording material is slow in the change of its temperature, and is cooled down to the room temperature only after 35 seconds as a result of an experiment.

Figure 4:
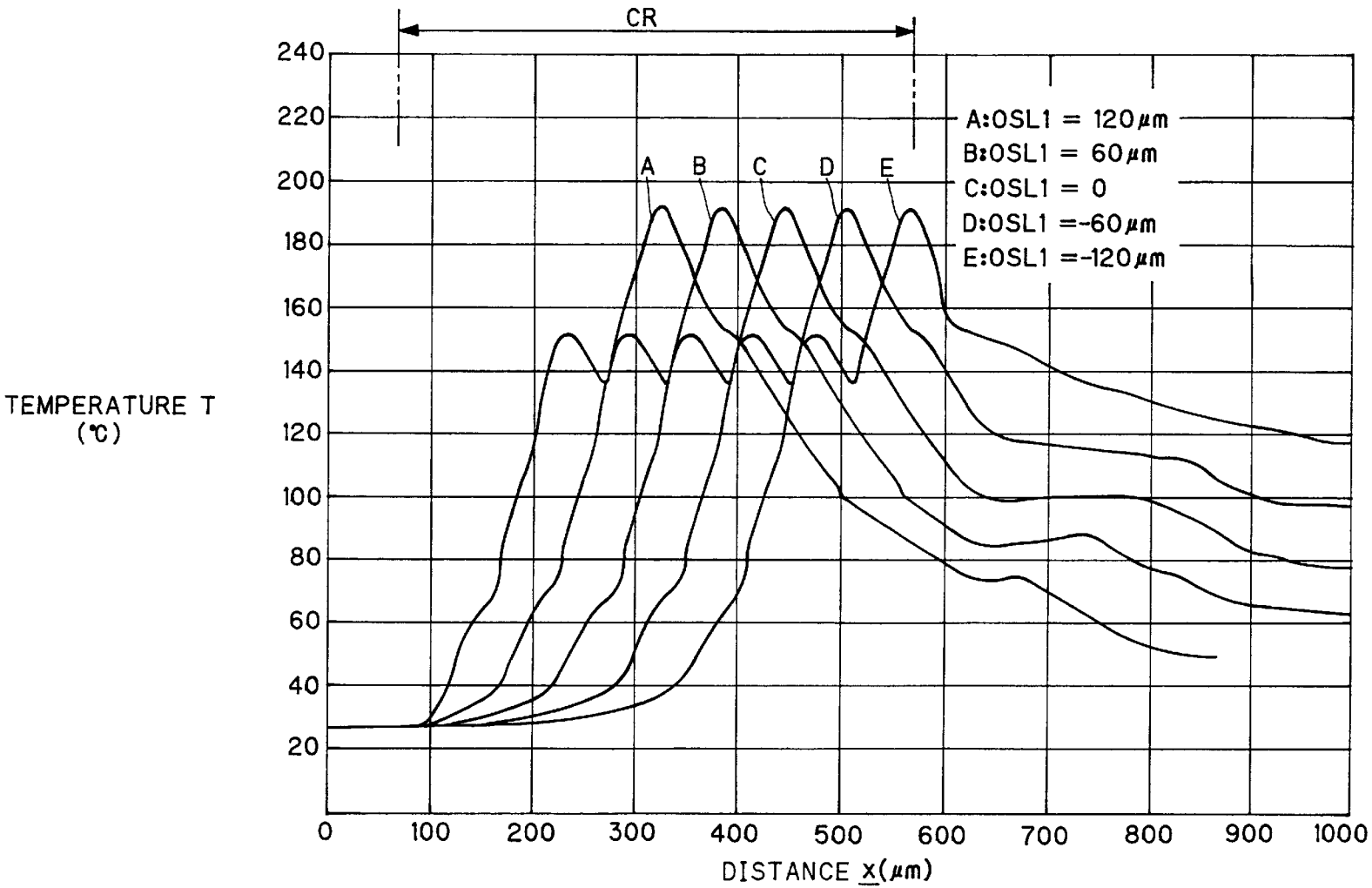
FIG. 4 is a graph illustrating a simulated relationship between the offset distance OSL1 of the heating elements and changes in temperature of the cyan coloring layer.

The result obtained from the simulation in the thermal analysis is depicted in FIG. 4, that is a graph illustrating a relationship between the offset distance OSL1 of the heating elements 5 and changes in temperature of the cyan coloring layer. The horizontal axis is taken for the distance x in μm or a relative on the recording material. The vertical axis is taken for the temperature in ° C. Curves A–E indicate results of setting the offset distance OSL1 at the five different values: Curve A for OSL1=120 μm, Curve B for OSL1=60 μm, Curve C for OSL1=0 μm, Curve D for OSL1=−60 μm, and Curve E for OSL1=−120 μm. It was observed that the temperature after passage of the heating elements changed and depended upon the changes in the offset distance OSL1 of the heating elements.

In FIG. 1, the contact region CR where the thermal head contacts the recording material 2 is split into a pre-contact surface UCR, a heating surface MCR and a post-contact surface LCR. The heating surface MCR is located outside the heating elements 5 to apply heat to the recording material 2. The pre-contact surface UCR is located upstream from the heating surface MCR. The post-contact surface LCR is located downstream from the heating surface MCR. As a result of the experiment, a post-contact surface length LCRL of the post-contact surface LCR with reference to the conveying direction was found to have a greater effect to changes in the density and surface smoothness or gloss than the length of the heating surface MCR or that of the pre-contact surface UCR.

When the post-contact surface length LCRL was changed, the density was changed. The smaller the post-contact surface length LCRL was, the more dependent the density was upon the post-contact surface length LCRL. It is concluded that changes in the density were reduced by enlarging the post-contact surface length LCRL in comparison with that according to the prior art. When the post-contact surface length LCRL was sufficiently greater, a separating point PP, where the heating elements start separating from the recording material, was the farther from the heating elements 5. Even when the separating point PP changed due to changes in tension of the recording material 2, there was only reduced influence due to the changes in the separating point PP, so that changes the density were reduced. Moreover, the post-contact surface LCR was smoothed and flat to press and cool the recording material. A surface of the recording material 2 was provided with high quality and much gloss. With the post-contact surface LCR maintained long in the conveying direction, there were only small influence of changes in the tension of the recording material 2. Only small changes in pressure occurred even with the changes in the tension. Consequently the changes in density due to the changes in the pressure were reduced. It was possible to stabilize the contacting condition between the recording material 2 and the ridge-shaped head component 3, reduce changes in the density, and avoid lowering the gloss. The recording material 2 is cooled by pressure of the post-contact surface LCR, to heighten the gloss of the recording material 2.

Note that the post-contact surface LCR is hereinafter referred to as cooling surface LCR.

To determine the cooling surface length LCRL greater than that in the prior art, the thermal head is pressed against the recording material by setting the center of the contact region CR downstream from the heating element center TCL of the heating elements. To condition the thermal head in this manner, it is possible to position a center of the platen roller downstream from the heating element center TCL.

In the thermal head in which the heating elements are arranged on the partial glaze, it is possible to dispose the heating elements in an upstream offset position from the center of the partial glaze for the purpose of ensuring greatness of the cooling surface length LCRL. A platen member such as a platen roller is disposed in an upstream offset position from the center of the partial glaze.

In the foregoing description, the heating elements are offset relative to the partial glaze. Alternatively it is possible in the present invention to utilize a known thermal head in which the center of heating elements is positioned at the top of the partial glaze. With such a thermal head, the heating elements and the platen roller are so disposed that a virtual straight line passing both the center of the heating elements and the rotational center of the platen roller is determined with inclination to intersect the conveying direction of the recording material. Consequently the cooling surface length LCRL is determined greater than that according to any manner of thermal printing known so far conventionally.

Figures 1A, 5:
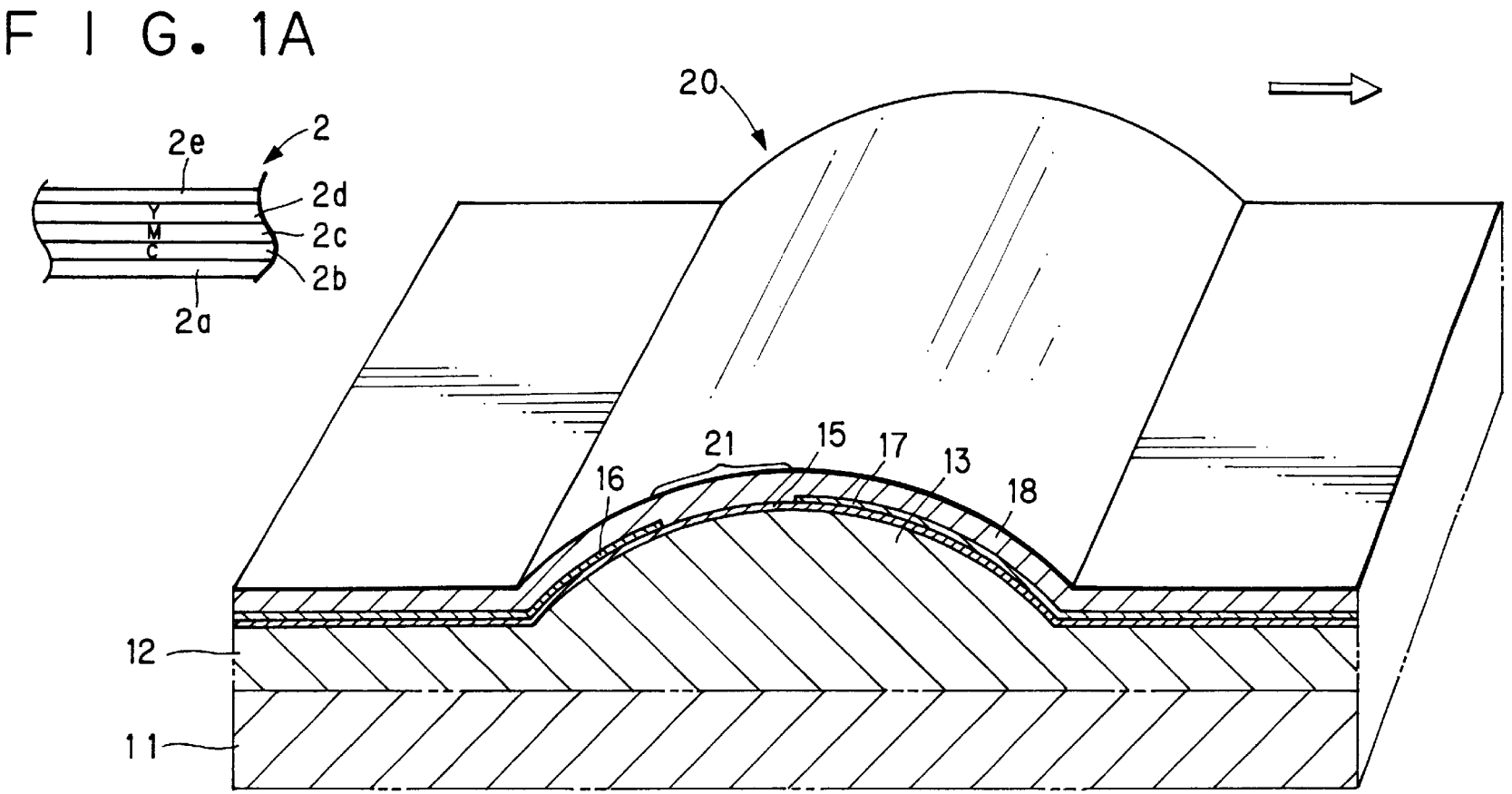
FIG. 1A is a cross section illustrating the recording material with layers.
FIG. 5 is a perspective, partially in section, illustrating another preferred thermal head.

In FIG. 5, a thermal head of a heating-element-offset-type is depicted. There is an alumina base plate 11, having a surface on which a flat glazed layer 12 is flatly disposed. A partial glaze 13 is protruded from the flat glazed layer 12 and shaped as a ridge or a portion of a cylinder. To form the flat glazed layer 12, a coating of glass paste is applied to the base plate 11, and heated, melted and cooled to become the flat glazed layer 12. For forming the partial glaze 13, the flat glazed layer 12 in the initially flat shape is used. The flat glazed layer 12 is etched, heated again, melted and formed for the shape of the partial glaze 13. The flat glazed layer 12 is 35 $\mu$m thick. The partial glaze 13 has a maximum thickness of 70 $\mu$m. Of course it is possible to change those thicknesses as suitable for any used type of recording medium and recording system. A preferable range of the thickness of the flat glazed layer 12 is 20–2,000 $\mu$m. A preferable range of the maximum thickness of the partial glaze 13 is 50–2,050 $\mu$m. A preferable range of a radius of a curved surface of the partial glaze 13 is 1–8 mm.

There are a resistor membrane or resistor film 15 and electrodes 16 and 17 disposed on surfaces of the partial glaze 13 and the flat glazed layer 12. A protective layer 18 of glass is layered to cover the resistor membrane 15 and the electrodes 16 and 17, to obtain a heating element array 20 or ridge-shaped head component. The resistor membrane 15 consists of thin membrane of heat emitting resistor, and deposited on the surfaces of the flat glazed layer 12 and the partial glaze 13 in accordance with the sputtering method, the vacuum deposition method, the CVD method or other suitable methods. Preferred examples of the heat emitting resistor membrane are Ni—Cr, $Ta_2N$, Ta—$SiO_2$, Ta—Si, Ta—Si—C, Cr—Si—O, ZrN, Ta—SiC, poly—Si and the like.

Figure 6:
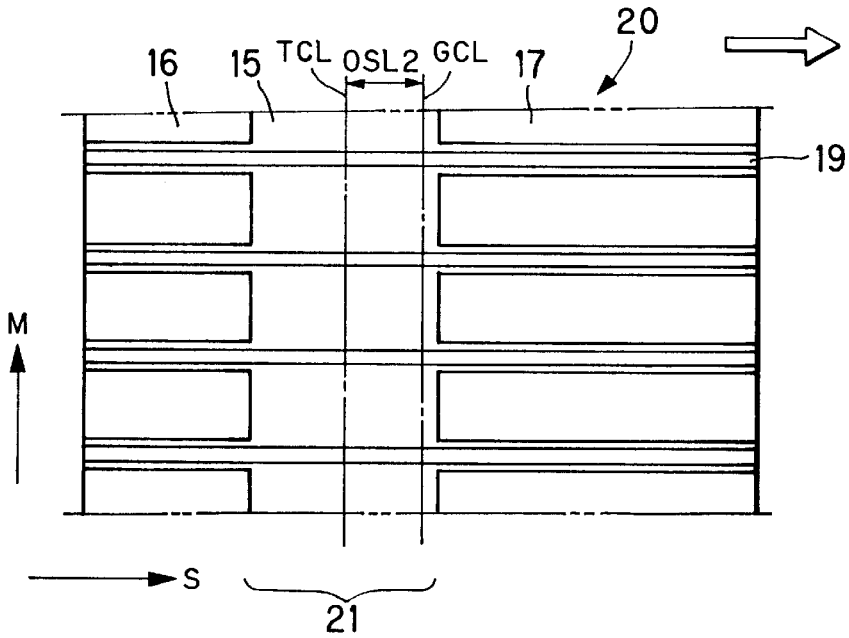
FIG. 6 is a plan illustrating the thermal head.

In FIG. 6, the ridge-shaped head component 20 is depicted in enlargement. The electrodes 16 and 17 have shapes of teeth of a comb. Portions of the resistor membrane 15 between the electrodes 16 and 17 respectively constitute heating elements 21. Each of the heating elements 21 has a width of 78 $\mu$m in a main scan direction M and a length of 225 $\mu$m in a sub scan direction S. The electrodes 16 and 17 are arranged in such positions that the heating element center TCL passing the center of the heating elements 21 is offset from an offset distance OSL2=180 $\mu$m in the upstream direction from a glaze center GCL or center line of the top of the partial glaze 13. See FIG. 1. Of course it is possible to change the size of the heating elements 21 as suitable for any used type of recording medium and recording system. The offset distance OSL2 is 180 $\mu$m, but may be changed as suitable in various manners. The electrodes 16 and 17 are formed of aluminum (Al), gold (Au) or the like, and deposited in accordance with the sputtering method, the vacuum deposition method, the CVD method or other suitable methods. In the present embodiment, slits 19 are formed in the resistor membrane 15 to etch the resistor membrane 15 in form split between the heating elements 21. Alternatively the heating elements 21 may be disposed without slitting the resistor membrane 15, simply with the electrodes 16 and 17.

Figure 7:
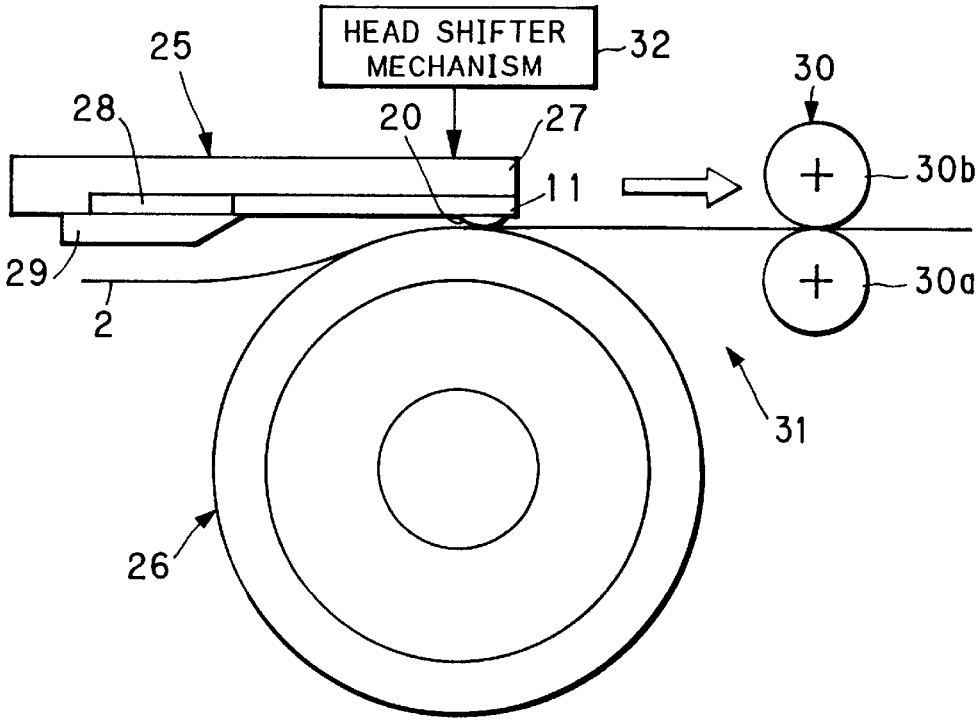
FIG. 7 is an explanatory view in elevation, illustrating a thermal printer including the thermal head.

In FIG. 7, disposition of a thermal head 25 and a platen roller 26 is illustrated. The base plate 11 or head chip with the ridge-shaped head component 20 is fixedly disposed on a head support plate 27 of metal, to constitute the thermal head 25. In the head support plate 27, there are an integrated circuit (IC) board 28 and an integrated circuit (IC) cover 29 for protecting the IC board 28. The IC board 28 selectively drives the respective heating elements. The thermal head 25 is secured to a chassis of a thermal printer by head support brackets (not shown).

Under the ridge-shaped head component 20 is disposed the platen roller 26. There are a pair of conveyor rollers 30 disposed downstream from the thermal head 25 in the conveying direction. The conveyor rollers 30 are constituted by a drive roller 30*a* and a nip roller 30*b*, which nip the recording material 2 to convey it by drawing it from the thermal head 25. A head shifter mechanism 32 is disposed on the head support brackets, and shifts the thermal head 25 between a recording position and a retracted position. The thermal head 25, when shifted in the recording position, is pressed toward the platen roller 26, and when shifted in the retracted position, is away from the platen roller 26. A printing mechanism 31 is constituted by the conveyor rollers 30, the thermal head 25, the platen roller 26 and the head shifter mechanism 32. Note that, instead of shifting the thermal head 25, the platen roller 26 may be shifted while the thermal head 25 is supported in a stationary manner.

Figure 8:
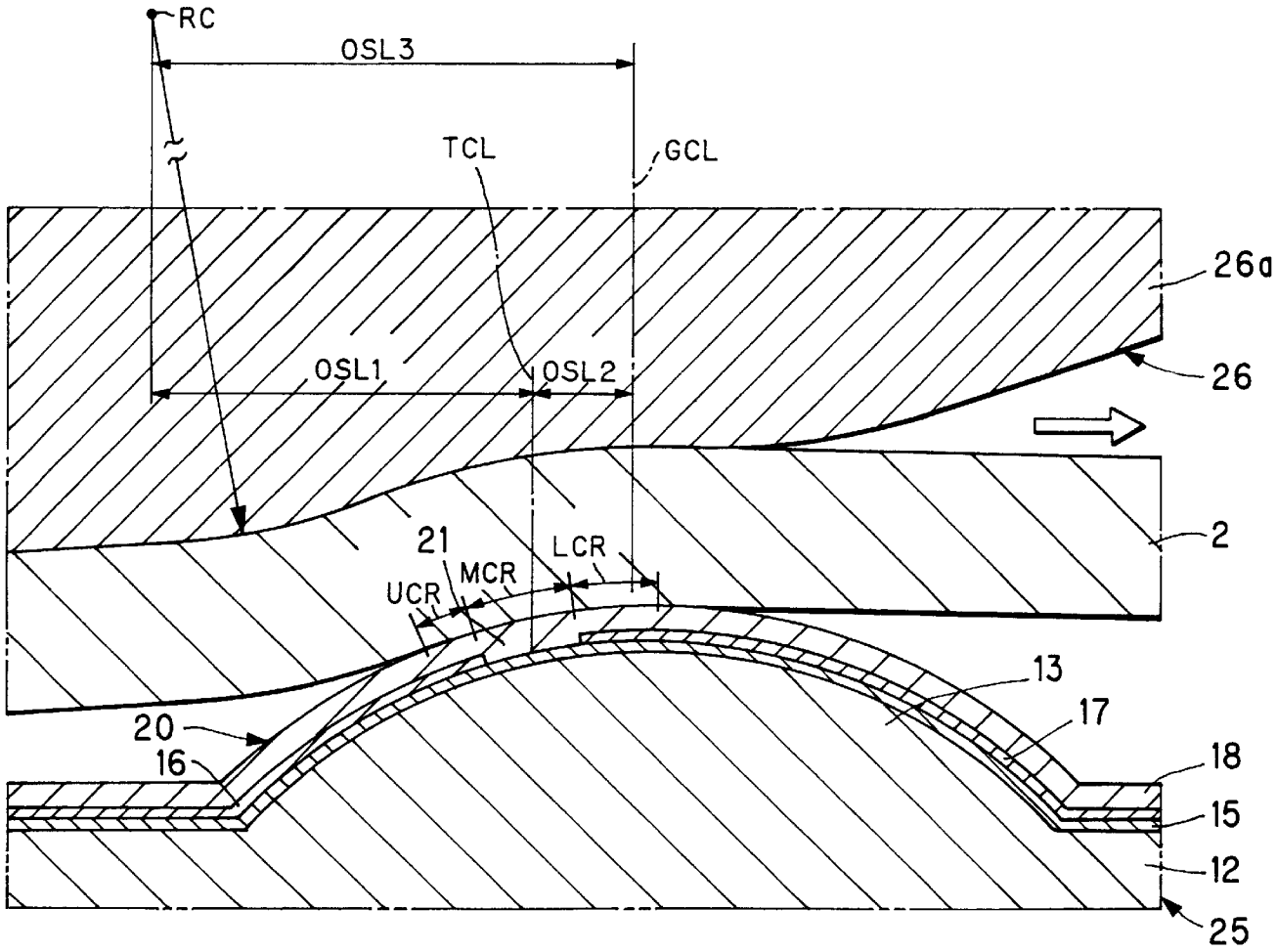
FIG. 8 is a cross section illustrating an arrangement of the thermal head, the recording material and a platen roller.

In FIG. 8, the platen roller 26 is disposed in such a manner that its roller center RC is offset by an offset distance OSL3=400 $\mu$m from the glaze center GCL of the partial glaze 13 in the upstream orientation as viewed in the conveying direction of the recording material. The platen roller 26 is pushed by the ridge-shaped head component 20. Note that the platen roller 26 is a rubber roller including a core and a rubber roll 26*a* fitted thereabout. It is possible to adjust the offset distance OSL3 as suitable for a diameter of the platen roller and the shape of the ridge-shaped head component 20 in a range of keeping the cooling surface length LCRL sufficiently great.

Figure 9:
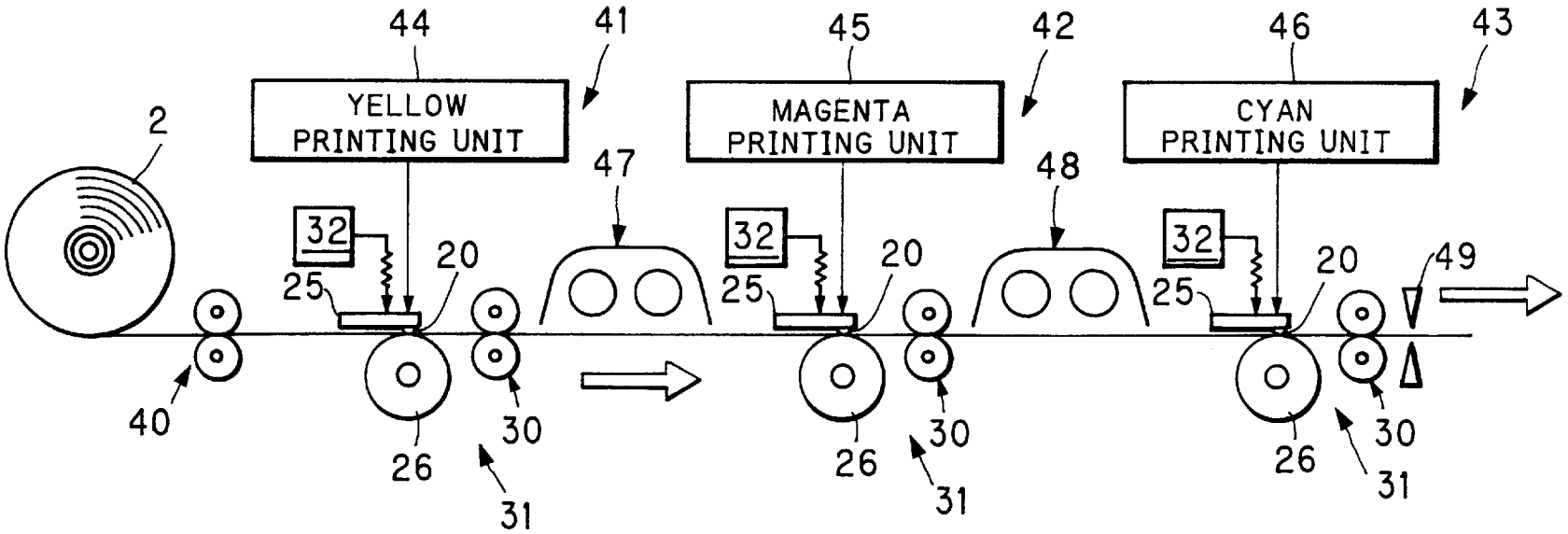
FIG. 9 is an explanatory view in elevation, illustrating the thermal printer.

In FIG. 9, a full-color thermal printer is illustrated. The recording material 2 in the roll form is drawn and un-wound by feeder rollers 40, and sent to a yellow printing station 41, a magenta printing station 42 and a cyan printing station 43 in the order listed. The yellow printing station 41 has a yellow printing unit 44 and the printing mechanism 31. The magenta printing station 42 has a magenta printing unit 45 and the printing mechanism 31. The cyan printing station 43 has a cyan printing unit 46 and the printing mechanism 31. Yellow, magenta and cyan images are recorded to each of single recording domains on the recording material 2 to record a full-color image. There is a yellow fixing unit 47 disposed between the yellow printing station 41 and the magenta printing station 42, for applying near-ultraviolet rays of a wavelength peaking at 420 nm to a recording domain after the yellow recording. There is a magenta fixing unit 48 disposed between the magenta printing station 42 and the cyan printing station 43, for applying ultraviolet rays of a wavelength peaking at 365 nm to the recording domain after the magenta recording. After the recording in the printing stations 41–43 and the fixation of the fixing units 47 and 48, the recording material 2 is cut by a cutter 49 frame from frame to obtain a full-color print.

Figure 10:
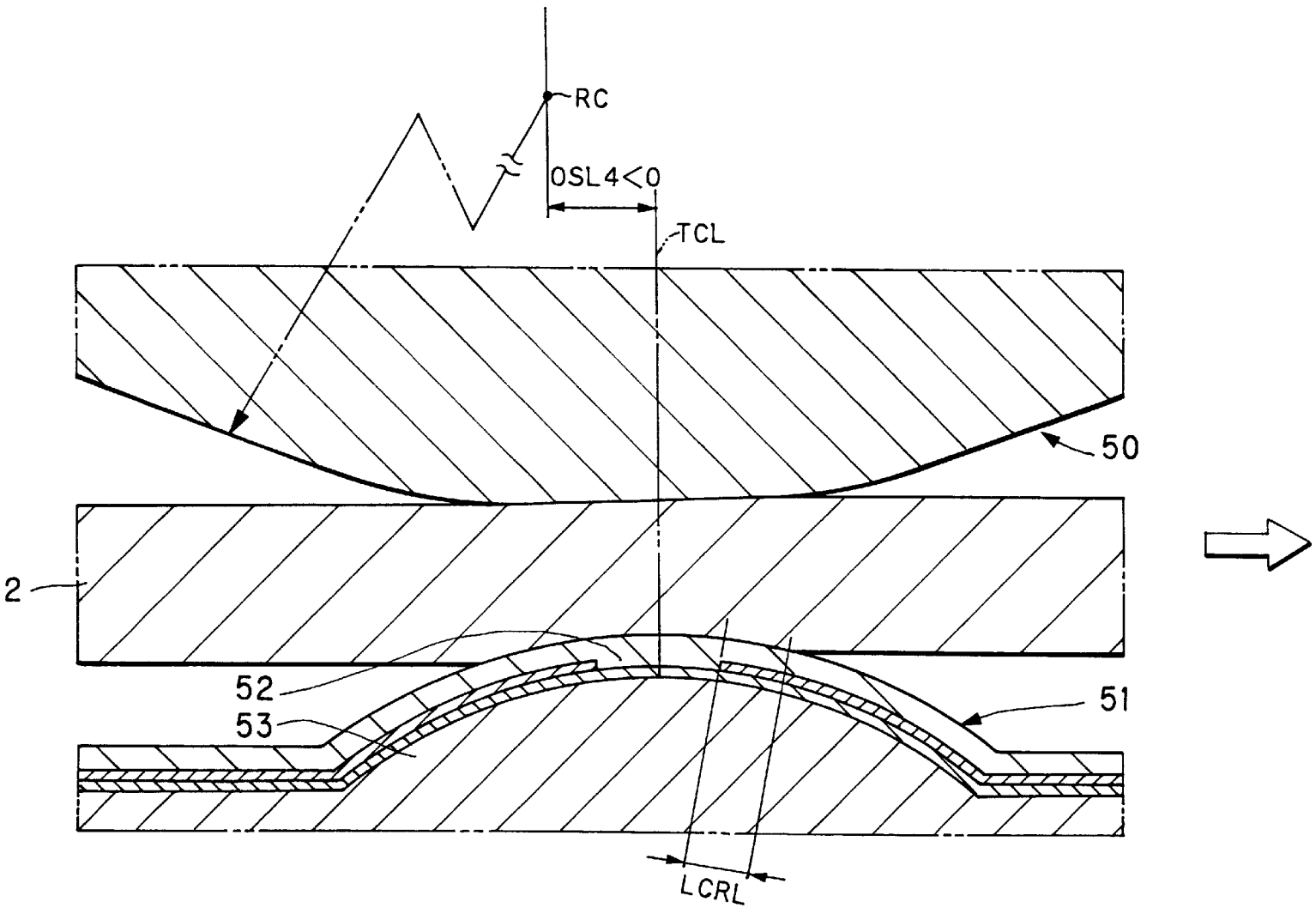
FIG. 10 is a cross section illustrating another preferred arrangement of a thermal head, the recording material and a platen roller.
Figure 10A:
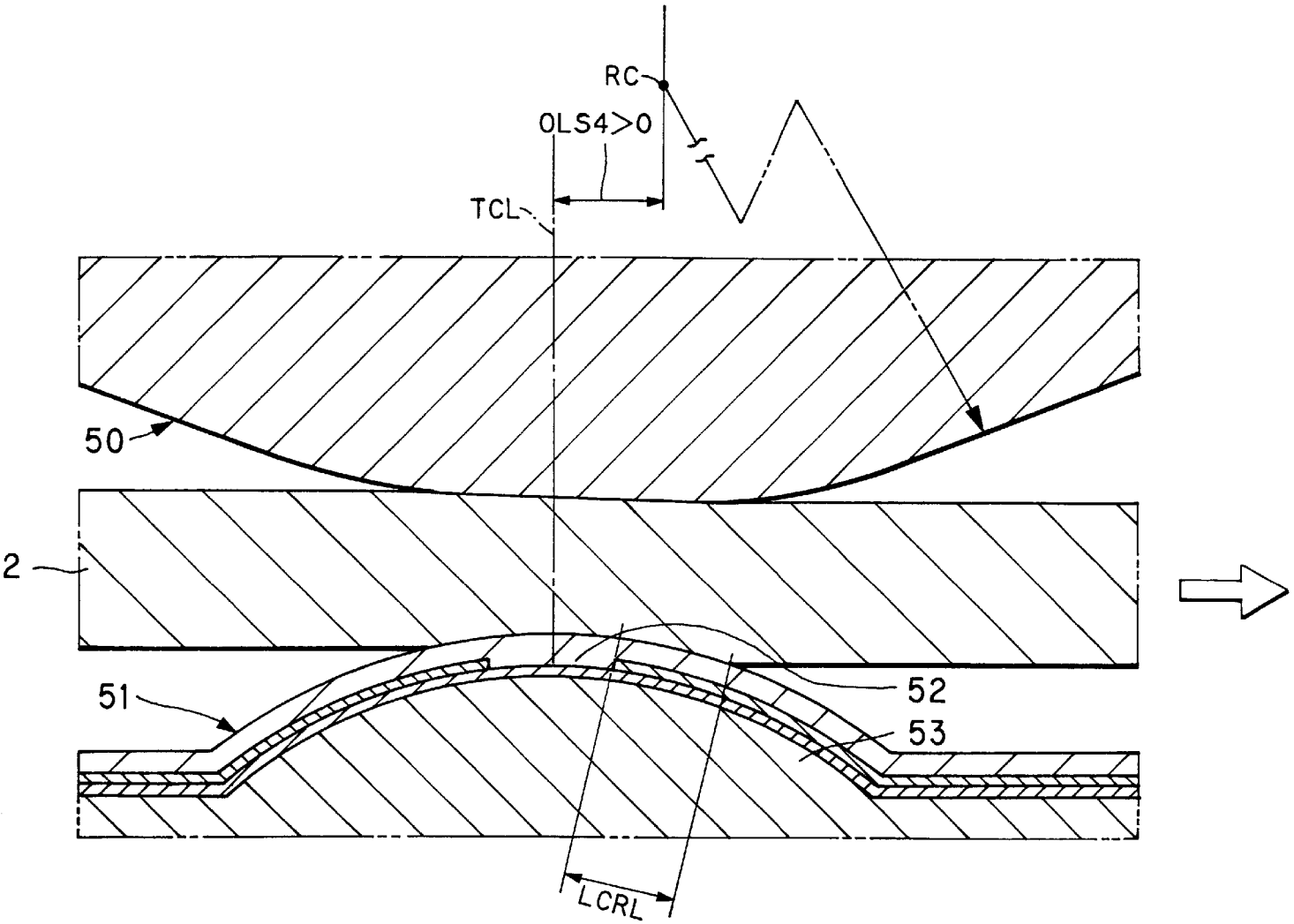
FIG. 10A is a cross section illustrating an arrangement of the thermal head, the recording material and the platen roller in a manner opposite to FIG. 10.

An experiment was conducted to check the effect of the present embodiment. In FIG. 10, a platen roller 50 was disposed with a change, to change a position of heating elements 52 in the contact region CR of contact between the recording material 2 and a heating element array 51 or ridge-shaped head component. An offset distance OSL4 was defined as a distance as viewed in the conveying direction and between the roller center RC of the platen roller 50 and the heating element center TCL or vertical line passing through the center of the heating elements 52 and vertical to the conveying direction. The offset distance OSL4 was defined positive (+) when the heating element center TCL was located upstream from the roller center RC, and negative (−) when the heating element center TCL was located downstream from the same. A relationship between the offset distance OSL4 and the coloring density was observed. To the heating elements 52, heat energy changing stepwise in four values was applied.

The printing experiment was conditioned as follows:

Thermal printer: full-color thermal printer NC-1 (trade name) manufactured by Fuji Photo Film Co., Ltd.

Recording material: P20 (trade name) manufactured by Fuji Photo Film Co., Ltd.

Printing speed: 10 mm/sec.

Period of powering: 14 msec.

Duration of powering: 11 msec or less.

Electric power: 0.234 W per one dot.

The ridge-shaped head component 51 known in the prior art was used, in which the center of the heating elements 52 was located at the center of a partial glaze 53. The heating elements 52 was 360 $\mu$m long in the conveying direction. A diameter of the platen roller was 50 mm.

Figure 11:
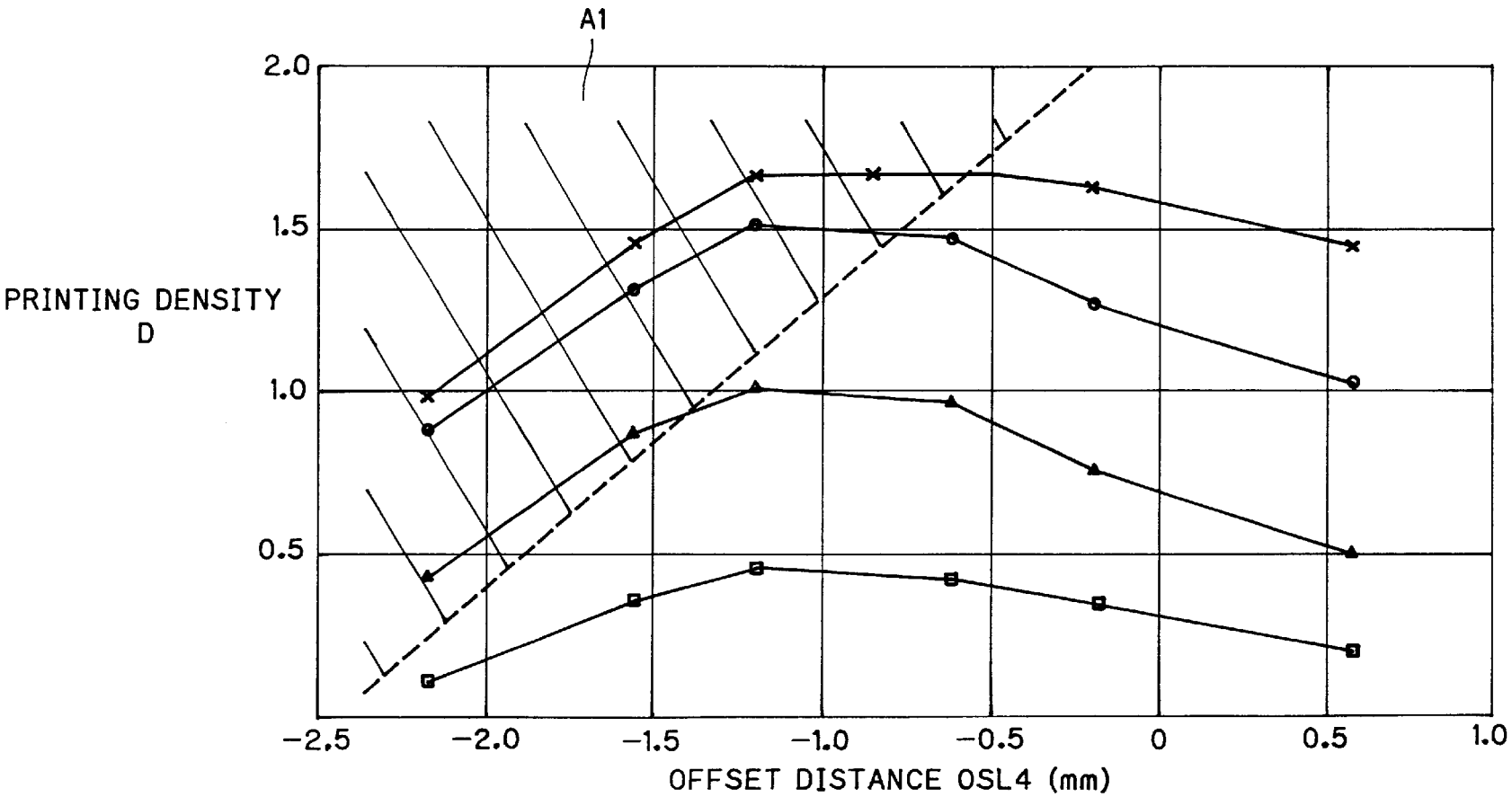
FIG. 11 is a graph illustrating an experimented relationship between occurrence of a blister and the offset distance OSL4, together with the coloring density.

A result of the experimental printing is illustrated in FIG. 11. The hatched area A1 designates a blister creating condition creating blister on the recording material. When the sign of the offset distance OSL4 was positive (+) then the heating elements were offset upstream from the platen roller 50. No blister was created even when the high heat energy was applied to the recording material. When the sign of the offset distance OSL4 was negative (−), then the heating elements were offset downstream from the platen roller 50. Considerable blister was created even the low heat energy was applied to the recording material. Consequently the cooling surface length LCRL was determined greater by lengthening the offset distance OSL4 in the positive manner. It was possible that the cooling surface LCR pressed the recording material 2 and cooled it sufficiently for the purpose of avoiding occurrence of blister on the recording material. Note that the four curves in the drawing respectively correspond to the four values of the heat energy.

It is also to be noted that, as depicted in FIG. 11, the offset distance OSL4 has a desirable range of OSL4≧−0.2 mm. The offset distance OSL4 may be negative but must not be smaller than −0.2 mm as a lower limit.

Figure 12:
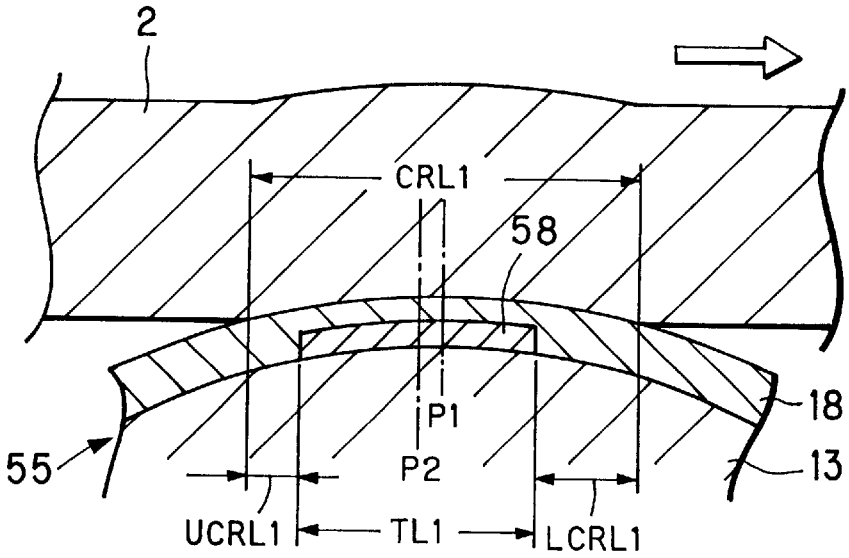
FIG. 12 is a cross section illustrating still another preferred embodiment in which the center P2 of heating elements is downstream offset from the center P1 of a contact region.
Figure 13:
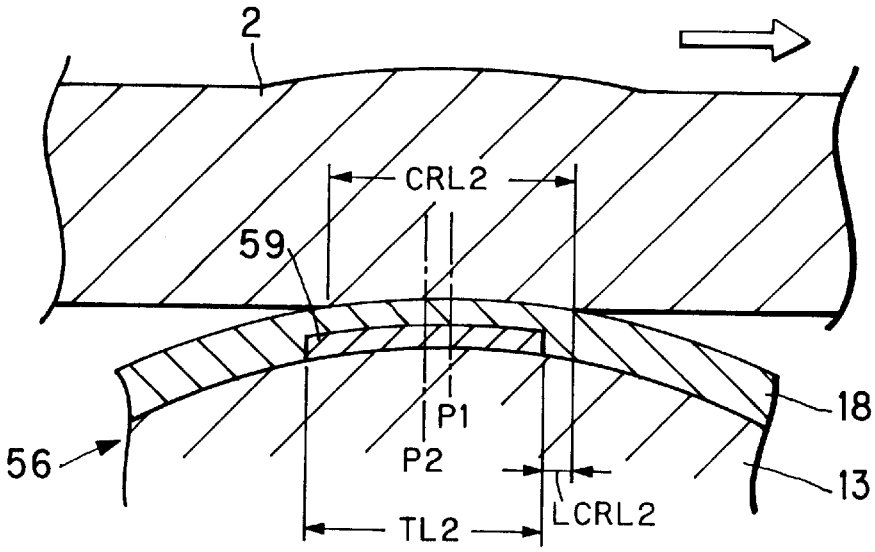
FIG. 13 is a cross section illustrating another preferred embodiment similar to that of FIG. 12 but in which a thermal head contacts the recording material in a different manner.
Figure 14:
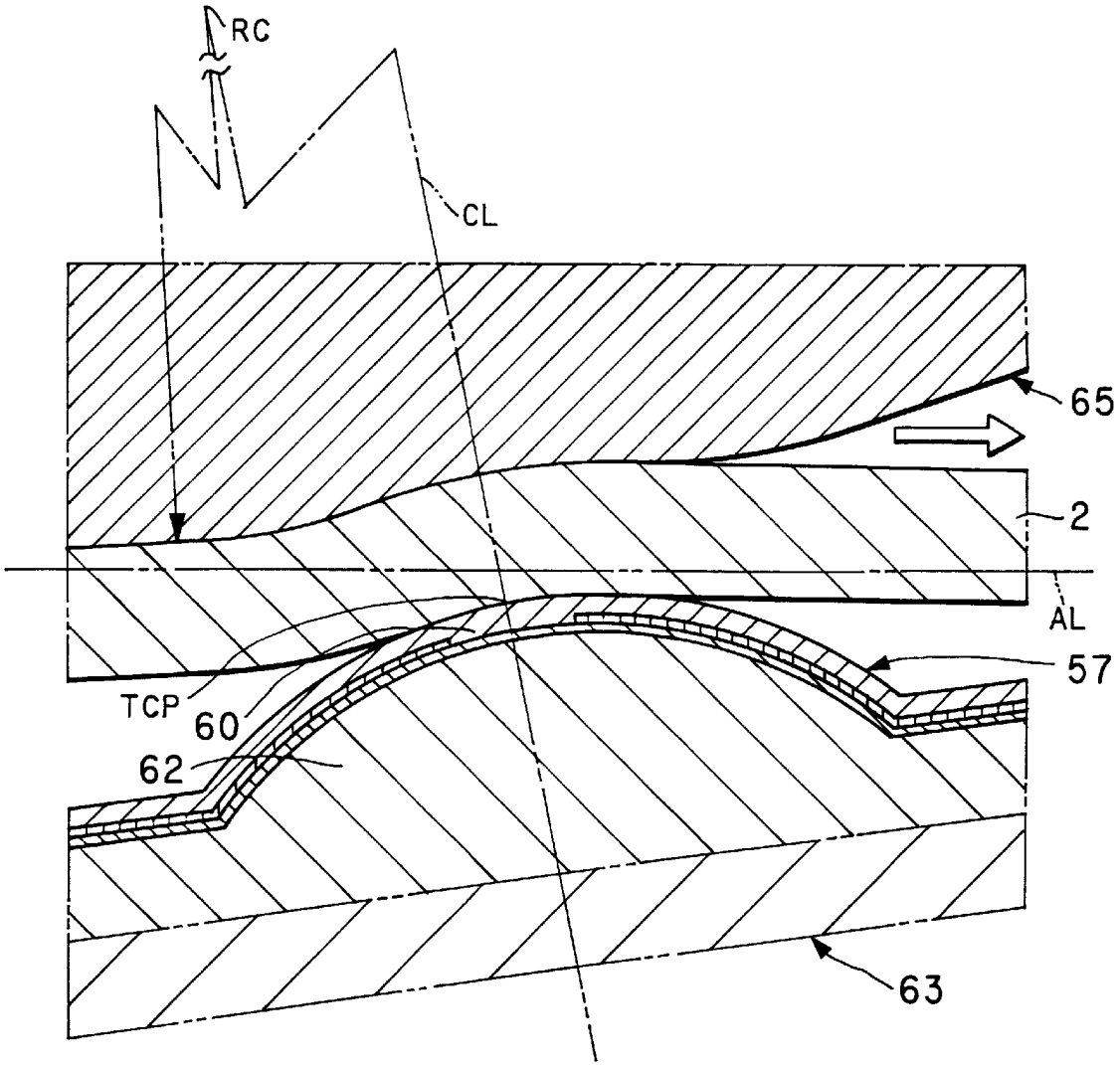
FIG. 14 is a cross section illustrating a preferred embodiment in which a straight line CL passing through the heating element center TCP of heating elements and the roller center RC of a platen roller is inclined with reference to a direction AL of conveyance of the recording material.

In the above embodiments, the heating elements in the thermal head are offset. FIGS. 12–14 illustrate other embodiments in which the center of the contact region is determined downstream from the center of the heating elements in the conveying direction. Head touch conditions for the same effects are obtained by offsetting the center of the platen roller downstream from the center of the heating elements. The contact region, where each of heating element arrays 55, 56 and 57 or ridge-shaped head components is contacted with the recording material 2, has a range equal to or longer than the range of the heating elements as viewed in the conveying direction.

In FIG. 12, another preferred embodiment is depicted, in which a thermal head is contacted in such a manner that a cooling surface length LCRL1 is greater than a pre-contact surface length UCRL1. A contact region length CRL1 is greater than a length TL1 of heating elements 58 in the conveying direction. A contact region center P1 is offset downstream with the heating elements 58 entirely kept in contact with the recording material 2. The cooling surface length LCRL1 and the pre-contact surface length UCRL1, therefore, meet LCRL1>UCRL1. If the contact region center P1 is further offset downstream, an upstream end of the heating elements 58 comes out of the contact region. This is still effective in preventing occurrence of irregularity in density, blister, and surface roughening, in spite of a partial waste of the heat energy from the heating elements 58.

In FIG. 13, a preferred embodiment is depicted, in which the ridge-shaped head component 56 is contacted in such a manner that a contact region length CRL2 is determined equal to a length TL2 of heating elements 59. To keep a cooling surface length LCRL2 sufficiently great, the contact region center P1 is downstream from a heating element center P2 of the heating elements 59. Also in the present thermal head, it is possible to prevent occurrence of irregularity in density, blister, and surface roughening.

In FIGS. 12 and 13, the lengths TL1 and TL2 of the heating elements 58 and 59 are equal to or smaller than the length CRL of the contact region CR between the recording material 2 and the ridge-shaped head components 55 and 56 with reference to the conveying direction. Alternatively a length of heating elements in the conveying direction may be greater than a contact region length CRL, namely TL≧CRL. Of course the heating elements can be offset upstream to keep the cooling surface length LCRL greater than that according to the prior art.

Also a thermal head 63 of FIG. 14 can be used, in which the cooling surface length LCRL is set greater than that of the prior art while the center of heating elements 60 is set nearly at the center of a partial glaze 62. The ridge-shaped head component 57 and a platen roller 64 are disposed such that a straight line CL passing through the heating element center TCP of the heating elements 60 and the roller center RC of the platen roller 64 intersects a direction AL parallel to the conveyance of the recording material 2, and is inclined with reference to the direction AL. This is similar in operation to the above embodiments in which the heating elements are offset upstream from the top of the partial glaze. The contacting condition between the ridge-shaped head component 57 and the recording material 2 is stabilized to prevent the density from changing and gloss from lowering. Note that the thermal head 63 having the conventional contour is likely to interfere the recording material due to the inclined disposition. It is preferable to cut away a small portion of an edge of the thermal head, namely the downstream edge of the thermal head nearer to the recording material 2.

A further preferred embodiment is described now, in which a thermal head as viewed in cross section is asymmetrical. In the above embodiments of FIGS. 5 and 12–14, the thermal head has a partially cylindrical shape on the periphery of the partial glaze. If the cooling surface length LCRL is enlarged, a radius of curvature of the cylindrical shape must be greater, to lower pressure to the recording material. Irregularity in density is likely to occur. In the present embodiment of FIG. 15 in contrast, a contour of partial glaze is shaped asymmetrically. To be precise, a surface of a downstream half of the partial glaze has a radius of curvature greater than a surface of an upstream half of the partial glaze, the downstream and upstream halves being defined with reference to the center of the partial glaze. The heating elements are disposed in a position offset upstream from the center of the partial glaze, so that a cooling surface can press and cool the recording material after being heated with the cooling surface length LCRL kept great. Accordingly the pressure between the recording material and the heating elements is kept sufficiently high. The surface smoothness or gloss of the recording material is heightened, to keep the printing quality high.

Figure 15:
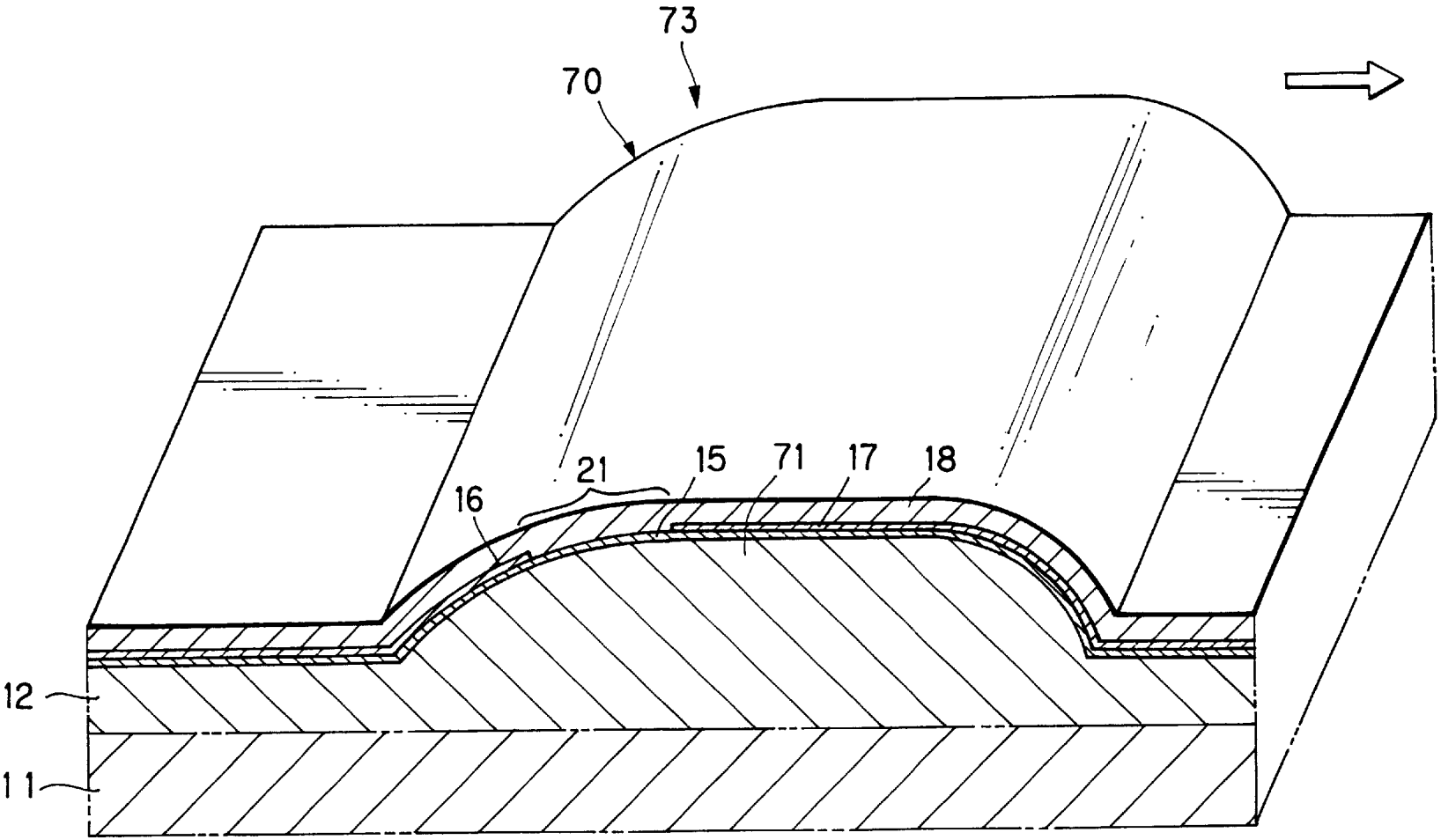
FIG. 15 is a perspective, partially in section, illustrating a preferred thermal head in which partial glaze is shaped asymmetrically.

In FIG. 15, another preferred thermal head is depicted, in which a heating element array 70 or ridge-shaped head component is asymmetrical in the conveying direction. Element similar to those in FIGS. 5 and 6 are designated with identical reference numerals. The most distinct feature of the present embodiment lies in the shape of a partial glaze 71. For forming the partial glaze 71, the flat glazed layer 12, which has the flat hardened shape, is etched, heated again, melted and formed for the shape asymmetrical and curved. Preferable ranges of thicknesses of the flat glazed layer 12 and the partial glaze 71 are the same as those of FIG. 5. Disposition of the electrodes and the offset distance OSL2 are also the same as those of FIG. 6.

Figure 16:
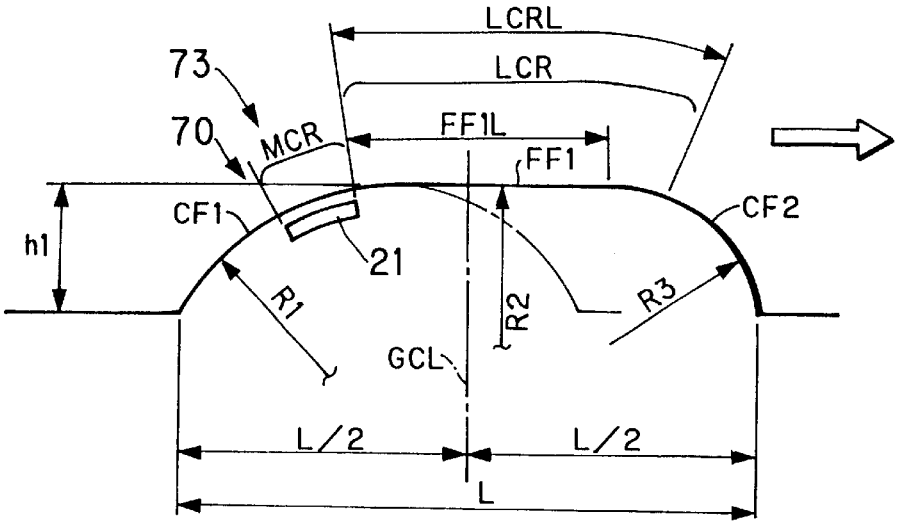
FIG. 16 is an explanatory view in cross section, illustrating the thermal head with indications of dimensions.

In FIG. 16, the ridge-shaped head component 70 is asymmetrical as viewed in section. An upstream half of the ridge-shaped head component 70 with reference to the glaze center GCL or center line of the ridge-shaped head component 70 is constituted by a rise surface CF1, which is shaped in an arc having a curvature radius R1=5 mm. A flat section FF1 is downstream adjacent to the rise surface CF1. Geometrically the flat section FF1 has a curvature radius R2 of infinity. A curved section CF2 is downstream adjacent to the flat section FF1, and is shaped in an arc having a curvature radius R3=3 mm. The thermal head structure has the height h1=65 $\mu$m. In the present thermal head, the cooling surface LCR is constituted of the flat section FF1 and a portion of the curved section CF2 for contact between the ridge-shaped head component 70 and the recording material 2. The cooling surface length LCRL of the cooling surface LCR is determined so as to cool the recording material down to temperature equal to or lower than glass transition point of the protective layer 2*e* of the recording material 2 upon separation of the recording material 2 from the cooling surface LCR. The cooling surface length LCRL is 600 $\mu$m in the present embodiment, and may be preferably 500 $\mu$m or more. Accordingly the recording surface of the recording material can be sufficiently cooled, reliably to prevent occurrence of irregularity in density, blister, and surface roughening.

Figure 21:
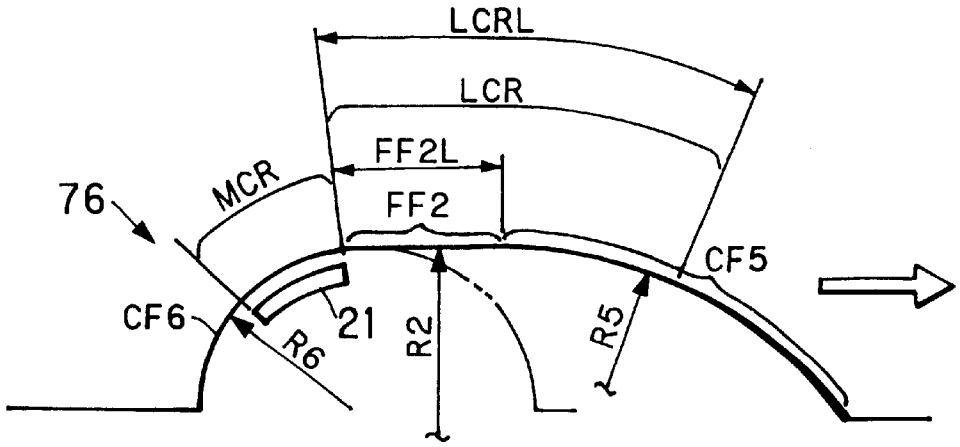
FIG. 21 is an explanatory view in cross section, illustrating yet another preferred thermal head.
Figure 22:
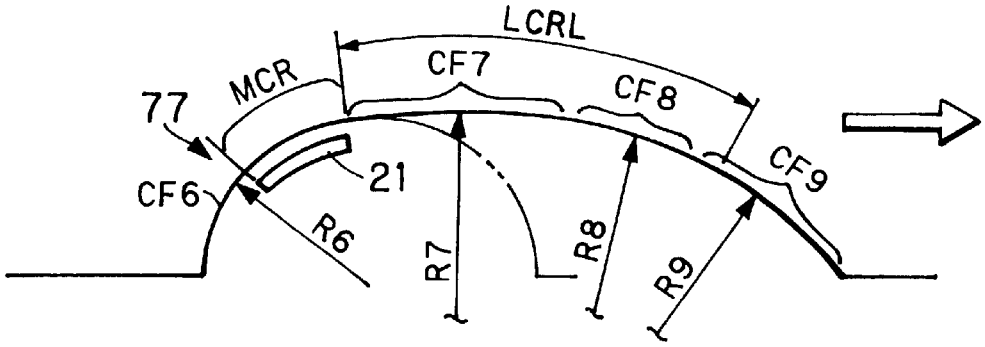
FIG. 22 is an explanatory view in cross section, illustrating another preferred thermal head.

A curvature radius R1 of the rise surface CF1 is 2–8 mm, and more preferably 2.5–7 mm. A curvature radius R3 of the curved section CF2 may be any value in comparison with the curvature radius R1 of the rise surface CF1. In FIG. 16, the curvature radius R3 of the curved section CF2 is smaller than that of the rise surface CF1. In FIGS. 21 and 22 to be described later, heating element arrays 76 and 77 or ridge-shaped head components respectively have a curved section CF5, of which a curvature radius R5 is greater than that of a rise surface CF6, and a curved section CF9, of which a curvature radius R9 is greater than that of a rise surface CF6. However it is more preferable that the curvature radius R3 of the curved section CF2 is smaller than the curvature radius R1 of the rise surface CF1, for example 1 mm$\leqq$R3$\leqq$6 mm. Consequently it is possible to reduce a changeable range of the separating point PP where the recording material 2 comes away from the ridge-shaped head component 70 even if the change occurs due to changes in the tension of the recording material 2. See FIG. 18. Note that, in FIG. 15, the protective layer 18 is formed with a regular thickness relative to the partial glaze 13. A surface shape of the partial glaze 13 is substantially similar to that of the ridge-shaped head component 20 in terms of geometry. The size and contour of the partial glaze are determinable according to the deduction of thicknesses of the protective layer, resistor membrane and the electrodes from a size and contour of the heating element array or ridge-shaped head component.

Figure 17:
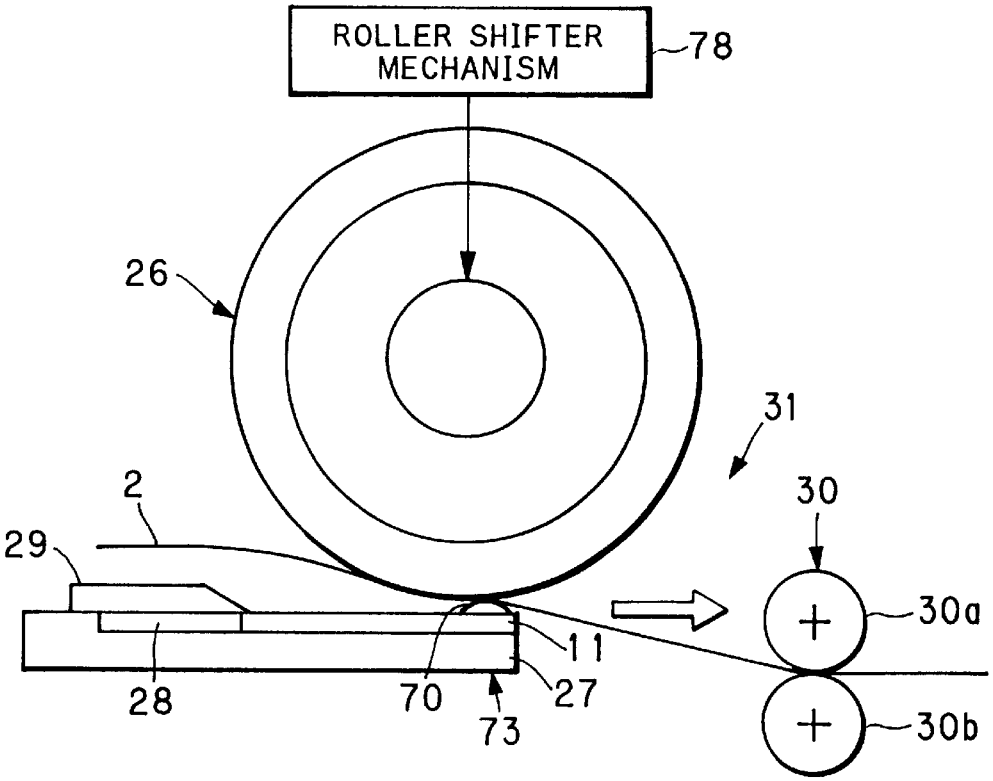
FIG. 17 is an explanatory view in elevation, illustrating a thermal printer including the thermal head.

FIG. 17 illustrates a relationship between the platen roller 26 and a thermal head 73 including the ridge-shaped head component 70. In FIG. 17, elements similar to those in FIG. 7 are designated with identical reference numerals. Unlike FIG. 7, the thermal printer of FIG. 17 has the thermal head 73 disposed under the platen roller 26. One feature of the present embodiment lies in that a nipping position of the conveyor rollers 30 is offset in a direction toward the alumina base plate of the thermal head away from the heating elements for contact with the recording material. Consequently it is possible to enlarge an amount of contact of the recording material 2 to the surface of the thermal head. The cooling surface length LCRL can be great.

The platen roller 26 is shifted by a roller shifter mechanism 78. The thermal head 73, when the platen roller 26 is shifted in the recording position, is pressed toward the platen roller 26. The platen roller 26, when shifted in the retracted position, is away from the thermal head 73.

Figure 18:
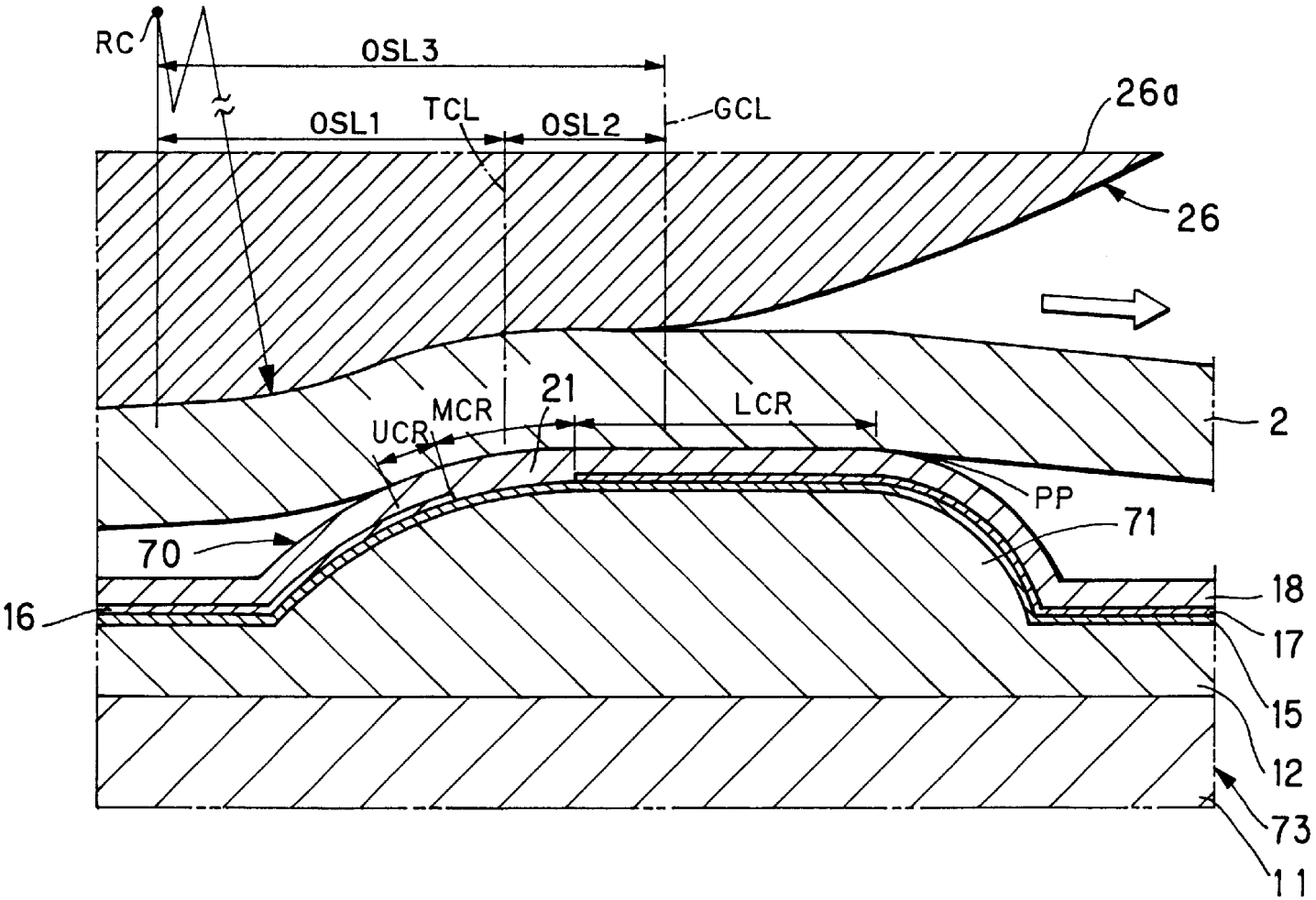
FIG. 18 is an explanatory view in cross section, illustrating an arrangement of the thermal head, the recording material and the platen roller.

In FIG. 18, the platen roller 26 is so disposed that its roller center RC is offset by the offset distance OSL3=400 $\mu$m from the glaze center GCL or center line vertical to the partial glaze 71 at its center. The periphery of the platen roller 26 is pressed against the ridge-shaped head component 70. Note that the offset distance OSL3 is sufficient if the cooling surface length LCRL is sufficient. The offset distance OSL3 may be changed according to a diameter of the platen roller 26 and a shape of the ridge-shaped head component 20.

An experiment was conducted to check the effect of the present embodiment. The thermal head was given the cooling surface length LCRL set at values of 100 $\mu$m, 300 $\mu$m and 500 $\mu$m, to observe a relationship between the cooling surface length LCRL and the surface gloss. Note that the characteristic of the surface gloss herein was obtained by measurement with a gloss measuring device VG-2000 (trade name) manufactured by Nippon Denshoku Kogyo Co., Ltd. and at a measuring angle of 20 degrees.

The printing experiment was conditioned as follows:

Thermal printer: full-color thermal printer NC-501 (trade name) manufactured by Fuji Photo Film Co., Ltd.

Recording material: A4-G50 (trade name) manufactured by Fuji Photo Film Co., Ltd.

Printing speed: 10 mm/sec.

Period of powering: 10 msec.

Duration of powering: 6 msec.

Electric power: 0.08 W per one dot.

The heating elements 52 had the cooling surface length LCRL of 100 μm, 300 μm and 500 μm, and had an entire length of 360 μm in the conveying direction.

Figure 19:
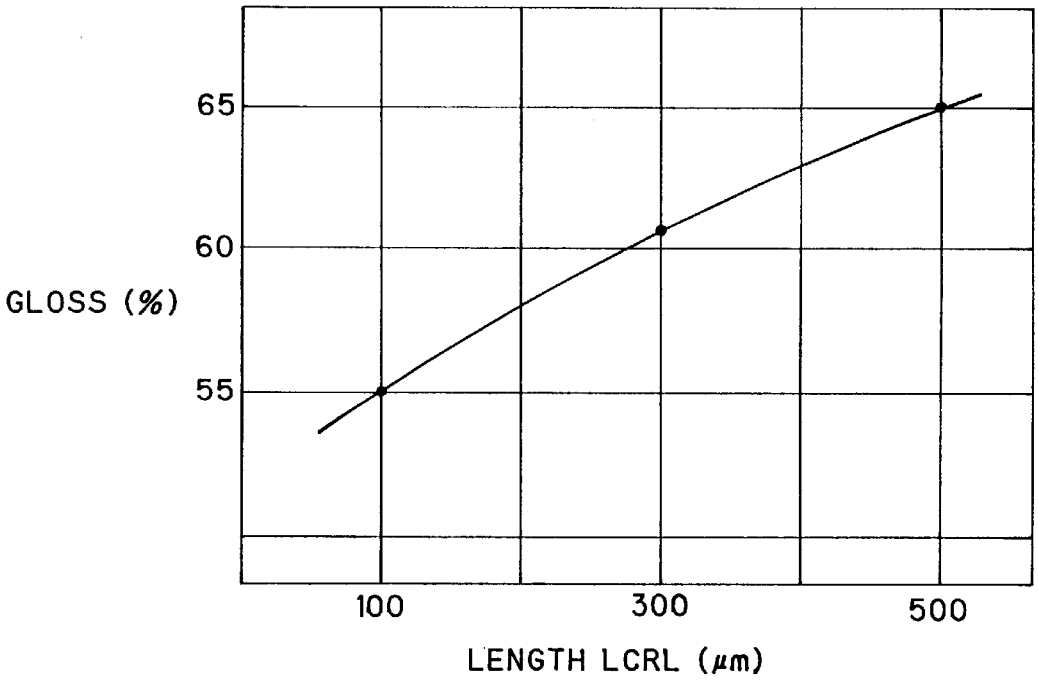
FIG. 19 is a graph illustrating a relationship between the cooling surface length LCRL and surface gloss.

A result of the experiment is shown in FIG. 19. When LCRL=100 μm, the surface gloss was 55%. When LCRL=300 μm, the surface gloss was approximately 60%. When LCRL=500 μm, the surface gloss was 65%. The greater the cooling surface length LCRL was, the higher the surface gloss was. The cooling surface LCR pressed and sufficiently cooled the recording material after being heated. The gloss of the recording material was heightened. Occurrence of irregularity in density, blister, and surface roughening was prevented.

Figure 20:
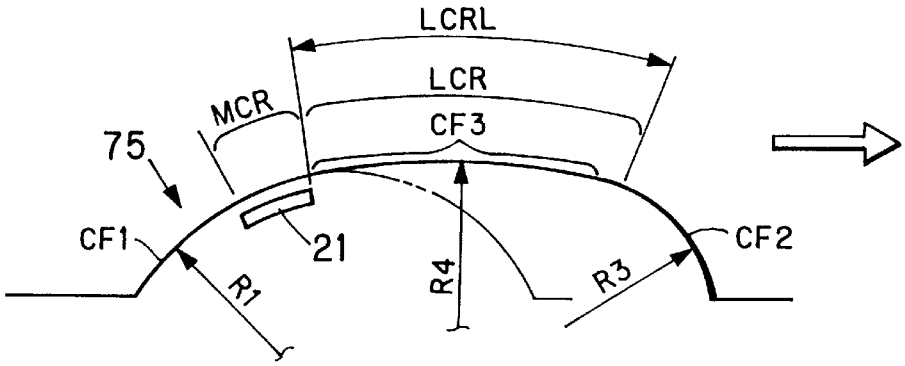
FIG. 20 is an explanatory view in cross section, illustrating another preferred thermal head.

Note that, instead of the flat section FF1 of FIG. 16, a heating element array 75 or ridge-shaped head component of FIG. 20 can be used, in which a curved section CF3 has a curvature radius R4 greater than the curvature radius R1 of the heating surface MCR. The cooling surface length LCRL is 500 μm or more. Also the ridge-shaped head component 76 in FIG. 21 can be used, in which a flat section length FF2L of a flat section FF2 adjacent to the heating surface MCR is set smaller than a flat section length FF1L of FIG. 16, the curved section CF5 is adjacent to the flat section FF2, and the curvature radius R5 of the curved section CF5 is set greater than a curvature radius R6 of the rise surface CF6. Furthermore the ridge-shaped head component 77 in FIG. 22 can be used, in which curved sections CF7 and CF8 and the curved section CF9 are used and have radii of curvature R7, R8 and R9 greater than the curvature radius R6 of the heating surface MCR, to lengthen the cooling surface LCR. In FIGS. 16 and 20–22, the phantom lines indicate the conventional thermal head with the cylindrical ridge contour, for the purpose of comparison with the present invention.

It is to be noted that, in FIG. 22, the curvature radii R6–R9 have a relationship of R6<R9<R8<R7. Of course curvatures of the curved sections CF7–CF9 may have other relationships between them in various preferable manners. Furthermore, curves different from the arcs of circles may be used, for example elliptic and parabolic curves, and combinations of those and/or arcs.

Figure 23:
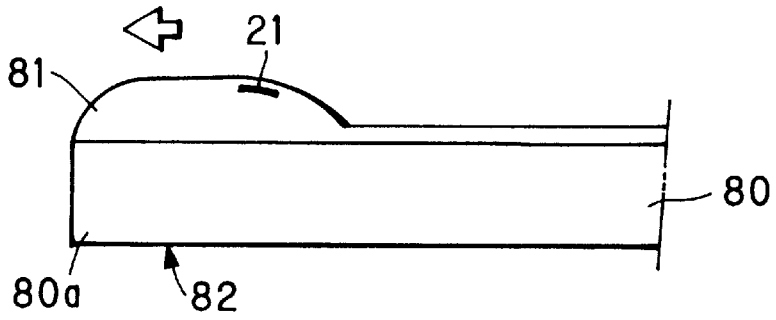
FIG. 23 is an explanatory view in elevation, illustrating a preferred thermal head of a corner edge type.
Figure 24:
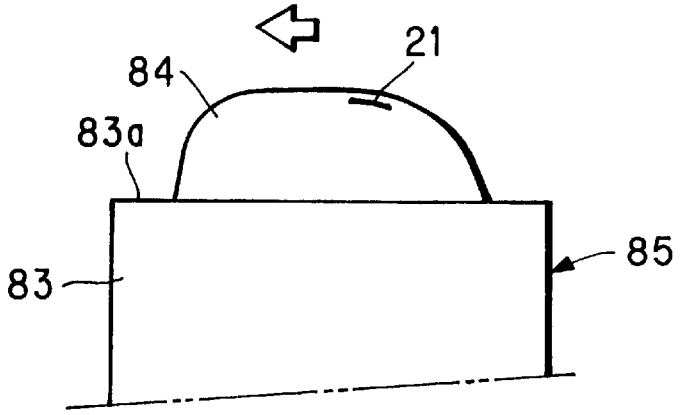
FIG. 24 is an explanatory view in cross section, illustrating a preferred thermal head of an end face type.

Moreover, it is possible in the present invention to use a thermal head 82 of FIG. 23. The thermal head 82 is a corner edge type, and has a base plate 80 and a heating element array 81 or ridge-shaped head component disposed on an end 80*a* of the base plate 80. Also in FIG. 24, an end face type of thermal head 85 may be used. The thermal head 85 includes an upright base plate 83 and a heating element array 84 or ridge-shaped head component disposed on a top end face 83*a* of the upright base plate 83. If a glaze etching is used, it is possible to leave a downstream half of the partial glaze without being etched, for the purpose of forming a flat section on the thermal head. A combination of the flatly remaining glaze and the partial glaze constitutes the heating element array or the ridge-shaped head component.

Note that the above thermal printer is a one-pass three-head type, in which the recording material is moved for one time past the thermal heads, and subjected to the three-color frame-sequential recording method to obtain a full-color image. Alternatively the present invention may be used in a three-pass one-head type of thermal printer in which the recording material is moved back and forth for three times past one thermal head, and subjected to the three-color frame-sequential recording method to obtain a full-color image. Also the thermal printer in the present invention may be a platen drive type, in which a platen shaft is rotated to convey recording material on a platen roller or platen drum. Again the gloss of the recording surface of the recording material can be heightened.

In the above embodiments, the thermal head is used in a direct full-color thermal printer of which thermosensitive sheet material is heated to obtain a printed material directly. Alternatively a thermal head of the present invention may be a thermal melt type or thermal wax transfer type, so that a contacting state between an ink ribbon and the thermal head can be kept stable. In the above embodiments, the partial glaze is ridge-shaped and partially cylindrical. Of course a partial glaze may be shaped in a quadrangle or trapezoid as viewed in cross section. The contour of the surface of the ridge shape are constituted of straight lines or arcs, but may be constituted of lines of curves of any form in any combination. The present invention may be used in a monochromatic thermal printer for use with monochromatic recording material, in which only one coloring layer is formed.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printing method, in which a thermosensitive recording material is conveyed and heat is applied by a thermal head to said recording material, to record an image to said recording material, said thermal head incorporating plural heating elements, arranged in an array crosswise to a predetermined conveying direction of said recording material, for generating said heat, said thermal printing method comprising a step of:

advancing said recording material in said conveying direction via a pair of conveyor rollers; and pressing said thermal head against said recording material in a contact region predetermined on said thermal head such that during a printing operation, a center of said contact region is positioned downstream from a center of said heating elements with reference to said conveying direction, wherein said thermal head is pressed against said recording material in a heating surface and a cooling surface predetermined in said contact region, said heating surface being disposed on an outside of said heating elements for conducting said heat to said recording material, said cooling surface being disposed downstream adjacent to said heating surface in said conveying direction for cooling said recording material, wherein a back of said recording material is supported by a platen member while said recording material is pressed by said thermal head, wherein said recording material includes (1) a support, (2) at least one thermosensitive coloring layer overlaid on said support, and (3) a protective layer, overlaid on said coloring layer, for protection thereof, and wherein said cooling surface has a predetermined length with reference to said conveying direction, said predetermined length being so predetermined as to cool said recording material down to temperature equal to or lower than a glass transition point of said protective layer.

2. A thermal printing method as defined in claim 1, wherein said thermal head includes:

a base plate; and a partial glaze disposed to project from said base plate in a ridge shape with smooth convexity, said heating elements being arranged on said partial glaze, said partial glaze pressing said recording material;

further comprising a step of nipping said recording material in a nip position determined downstream from said thermal head with reference to said conveying direction, said nip position being offset from a projecting top of said partial glaze toward said base plate.

3. A thermal printing method as defined in claim 1, wherein said thermal head is pressed against said recording material in a pre-contact surface predetermined further in said contact region, said pre-contact surface being disposed upstream adjacent to said heating surface in said conveying direction, and said thermal head satisfies a condition of:

$$LCRL>UCRL$$

where UCRL is a length of said pre-contact surface with reference to said conveying direction, and LCRL is a length of said cooling surface with reference to said conveying direction.

4. A thermal printing method as defined in claim 1, wherein said platen member is disposed upstream offset from said center of said heating elements in said conveying direction.

5. A thermal printing method as defined in claim 1, wherein said platen member is so disposed that said recording material is conveyed in a direction inclined with reference to a central line which passes said center of said heating elements and is vertical to said heating surface.

6. A thermal printing method as defined in claim 1, wherein said thermal head includes:

a base plate; and a partial glaze disposed to project from said base plate in a ridge shape with smooth convexity, said heating elements being arranged on said partial glaze, said partial glaze pressing said recording material;

wherein at least either one of said platen member and said heating elements is disposed upstream offset from a center of said partial glaze in said conveying direction.

7. A thermal printing method as defined in claim 1, wherein said thermal head has a rise surface disposed between said heating surface and an upstream distal end of said thermal head with reference to said conveying direction, and at least partially curved at a first radius of curvature;

said cooling surface is flat or curved at a predetermined radius of curvature, said predetermined radius being greater than said first radius.

8. A thermal printing method, in which a thermosensitive recording material is conveyed and heat is applied by a thermal head to said recording material, to record an image to said recording material, said thermal head incorporating plural heating elements, arranged in an array crosswise to a predetermined conveying direction of said recording material, for generating said heat, said thermal printing method comprising a step of:

advancing said recording material in said conveying direction via a pair of conveyor rollers; and pressing said thermal head against said recording material in a contact region that has an asymmetrical contour in the conveying direction, said contact region with a heating surface, a pre-contact surface and a cooling surface predetermined on said thermal head, said heating surface being disposed on an outside of said heating elements for conducting said heat to said recording material, said pre-contact surface being disposed upstream adjacent to said heating surface in said conveying direction, and having a length UCRL with reference to said conveying direction, said cooling surface being disposed downstream adjacent to said heating surface in said conveying direction, and having a length LCRL with reference to said conveying direction, for cooling said recording material, and said pre-contact surface and said cooling surface satisfying a condition of:

$$LCRL>UCRL,$$

such that during a printing operation, a center of said contact region is positioned downstream from a center of said heating elements with reference to said conveying direction.

9. A thermal printing method comprising steps of:

conveying a thermosensitive recording material in a predetermined conveying direction via a pair of conveyor rollers;

recording an image to said recording material with a thermal head, wherein said thermal head includes a base plate, a partial glaze disposed to project from said base plate in a ridge shape having an asymmetrical contour in the conveying direction, and plural heating elements, arranged on said partial glaze and in an array crosswise to said conveying direction, for pressing and heating said recording material being conveyed; and receiving a back of said recording material on a platen member while said recording material is pressed by said thermal head, wherein a roller center of said platen member is disposed upstream offset from a center of said partial glaze in said conveying direction.

10. A thermal printing method, in which a thermosensitive recording material is conveyed and heat is applied by a thermal head to said recording material, to record an image to said recording material, said thermal head incorporating plural heating elements, arranged in an array crosswise to a predetermined conveying direction of said recording material, for generating said heat, said thermal printing method comprising steps of:

pressing said thermal head against said recording material in a heating surface and a cooling surface predetermined on said thermal head, said heating surface being disposed on an outside of said heating elements for conducting said heat to said recording material, said cooling surface being disposed downstream adjacent to said heating surface in said conveying direction, for cooling said recording material;

wherein said thermal head has a rise surface disposed between said heating surface and an upstream distal end of said thermal head with reference to said conveying direction, and at least partially curved at a first radius of curvature;

said cooling surface is flat or curved at a predetermined radius of curvature, said predetermined radius being greater than said first radius.

11. A thermal printing method as defined in claim 10, wherein said cooling surface is so extended that a center of said thermal head is located within a range of said cooling surface.

12. A thermal head for applying heat to a thermosensitive recording material conveyed in a predetermined conveying direction via a pair of conveyor rollers, to record an image thereto, comprising:

a base plate;

a partial glaze disposed to project from said base plate in a ridge shape;

plural heating elements, arranged on said partial glaze and in an array crosswise to said conveying direction, for generating heat, wherein said heating elements are disposed upstream offset from a center of said partial glaze in said conveying direction;

a heating surface, disposed on an outside of said heating elements, pressed against said recording material, for conducting said heat to said recording material; and a cooling surface, disposed downstream adjacent to said heating surface in said conveying direction, pressed against said recording material, for cooling said recording material, a center of a combined region of said heating and cooling surfaces being positioned downstream from a center of said heating elements with reference to said conveying direction, wherein said recording material includes (1) a support, (2) at least one thermosensitive coloring layer overlaid on said support, and (3) a protective layer, overlaid on said coloring layer, for protection thereof, wherein said cooling surface has a predetermined length with reference to said conveying direction, said predetermined length being so predetermined as to cool said recording material down to temperature equal to or lower than a glass transition point of said protective layer.

13. A thermal head as defined in claim 12, wherein said predetermined length is 500 $\mu$m or more.

14. A thermal head as defined in claim 12, wherein said cooling surface is at least partially flat.

15. A thermal head as defined in claim 12, further comprising:

a rise surface disposed between said heating surface and an upstream distal end of said thermal head with reference to said conveying direction, and at least partially curved at a first radius of curvature;

wherein said cooling surface is flat or curved at a predetermined radius of curvature, said predetermined radius being greater than said first radius.

16. A thermal printer comprising:

a conveyor for conveying a thermosensitive recording material in a predetermined conveying direction;

a thermal head for applying heat to said recording material being conveyed, to record an image to said recording material, said thermal head incorporating plural heating elements, arranged in an array crosswise to said conveying direction, for generating said heat;

wherein said thermal head includes a contact region predetermined for pressing said recording material such that during a printing operation, a center of said contact region is positioned downstream from a center of said heating elements with reference to said conveying direction;

wherein said contact region includes (1) a heating surface, disposed on an outside of said heating elements, for conducting said heat to said recording material, and (2) a cooling surface, disposed downstream adjacent to said heating surface in said conveying direction, for cooling said recording material; and a platen member, disposed opposite to said thermal head, for supporting a back of said recording material pressed by said thermal head;

wherein said recording material includes (1) a support, (2) at least one thermosensitive coloring layer overlaid on said support, and (3) a protective layer, overlaid on said coloring layer, for protection thereof;

wherein said cooling surface has a predetermined length with reference to said conveying direction, said predetermined length being so predetermined as to cool said recording material down to temperature equal to or lower than a glass transition point of said protective layer.

17. A thermal printer as defined in claim 16, wherein said predetermined length is 500 $\mu$m or more.

18. A thermal printer as defined in claim 16, wherein said cooling surface is at least partially flat.

19. A thermal printer as defined in claim 16, wherein said conveyor includes at least one pair of nip rollers, disposed downstream from said platen member in said conveying direction, for nipping said recording material for conveyance.

20. A thermal printer as defined in claim 19, wherein said thermal head includes:

a base plate; and a partial glaze disposed to project from said base plate in a ridge shape with smooth convexity, said heating elements being arranged on said partial glaze, said partial glaze pressing said recording material;

wherein said nip rollers have a nip position therebetween where said recording material is nipped, and said nip position is offset from a projecting top of said partial glaze toward said base plate.

21. A thermal printer as defined in claim 16, wherein said contact region has a length substantially equal to a length of said heating elements with reference to said conveying direction.

22. A thermal printer as defined in claim 16, wherein said contact region further includes a pre-contact surface disposed upstream adjacent to said heating surface in said conveying direction, and said thermal head satisfies a condition of:

$$LCRL > UCRL$$

where UCRL is a length of said pre-contact surface with reference to said conveying direction, and LCRL is a length of said cooling surface with reference to said conveying direction.

23. A thermal printer as defined in claim 22, wherein said platen member is disposed upstream offset from said center of said heating elements in said conveying direction.

24. A thermal printer as defined in claim 22, wherein said platen member is so disposed that said recording material is conveyed in a direction inclined with reference to a central line which passes said center of said heating elements and is vertical to said heating surface.

25. A thermal printer as defined in claim 22, wherein said thermal head includes:

a base plate; and a partial glaze disposed to project from said base plate in a ridge shape with smooth convexity, said heating elements being arranged on said partial glaze, said partial glaze pressing said recording material;

wherein said heating elements are disposed upstream offset from a center of said partial glaze in said conveying direction.

26. A thermal printer as defined in claim 22, wherein said thermal head includes:

a base plate; and a partial glaze disposed to project from said base plate in a ridge shape with smooth convexity, said heating elements being arranged on said partial glaze, said partial glaze pressing said recording material;

wherein said platen member is disposed upstream offset from a center of said partial glaze in said conveying direction.

27. A thermal printer as defined in claim 26, wherein said platen member comprises a platen roller of which a rotational center is upstream offset from said center of said partial glaze.

28. A thermal printer as defined in claim 16, wherein said thermal head includes:

a base plate;

a partial glaze disposed to project from said base plate in a ridge shape with smooth convexity, said heating elements being arranged on said partial glaze, said partial glaze pressing said recording material; and a rise surface disposed between said heating surface and an upstream distal end of said partial glaze with reference to said conveying direction, and at least partially curved at a first radius of curvature;

said cooling surface is flat or curved at a predetermined radius of curvature, said predetermined radius being greater than said first radius.

29. A thermal printer as defined in claim 28, wherein said cooling surface is so extended that a center of said partial glaze is located within a range of said cooling surface.

30. A thermal printer as defined in claim 28, wherein said cooling surface includes:

a flat section disposed downstream adjacent to said heating surface; and a curved section, disposed downstream adjacent to said flat section, and having one radius of curvature, said one radius being smaller than said first radius.

31. A thermal printer as defined in claim 28, wherein said cooling surface includes:

a flat section disposed downstream adjacent to said heating surface; and a curved section, disposed downstream adjacent to said flat section, and having said predetermined radius of curvature.

32. A thermal printer as defined in claim 28, wherein said cooling surface includes:

a first curved section, disposed downstream adjacent to said heating surface, and having said predetermined radius of curvature;

a second curved section, disposed downstream adjacent to said first curved section, and having a second radius of curvature, said second radius being smaller than said predetermined radius; and a third curved section, disposed downstream adjacent to said second curved section, and having a third radius of curvature, said third radius being smaller than said second radius.

33. A thermal printer as defined in claim 28, wherein said partial glaze is disposed along an downstream edge of said base plate downstream with reference to said conveying direction.

34. A thermal printer as defined in claim 28, wherein said base plate is oriented substantially vertically to said conveying direction, and said partial glaze projects from an end face of said base plate in said ridge shape.

35. A thermal printer comprising:

a pair of conveyor rollers for conveying a thermosensitive recording material in a predetermined conveying direction; and a thermal head for applying heat to said recording material being conveyed, to record an image to said recording material, said thermal head incorporating plural heating elements, arranged in an array crosswise to said conveying direction, for generating said heat, said thermal head including a contact region that has an asymmetrical shape in the conveying direction, said contract region with a) a heating surface, disposed on an outside of said heating elements, pressed against said recording material, for conducting said heat to said recording material;

b) a pre-contact surface, disposed upstream adjacent to said heating surface in said conveying direction, and pressed against said recording material; and c) a cooling surface, disposed downstream adjacent to said heating surface in said conveying direction, pressed against said recording material, for cooling said recording material;

wherein said thermal head satisfies a condition of:

$$LCRL > UCRL,$$

where UCRL is a length of said pre-contact surface with reference to said conveying direction, and LCRL is a length of said cooling surface with reference to said conveying direction such that during a printing operation, a center of said contact region is positioned downstream from a center of said heating elements with reference to said conveying direction.

36. A thermal printer comprising:

a conveyor for conveying a thermosensitive recording material in a predetermined conveying direction;

a thermal head with a contact region for applying pressure and heat to said recording material being conveyed, to record an image to said recording material, said thermal head incorporating plural heating elements, arranged in an array crosswise to said conveying direction, for generating said heat, wherein said contact region has an asymmetrical contour in said conveying direction; and a platen member, disposed opposite to said thermal head, for supporting a back of said recording material pressed by said thermal head, wherein said platen member is disposed upstream offset from said center of said heating elements in said conveying direction.

37. A thermal printer, comprising:

a pair of conveyor rollers for conveying a thermosensitive recording material in a predetermined conveying direction; and a thermal head for recording an image to said recording material, said thermal head including i. a base plate;

ii. a partial glaze disposed to project from said base plate in a ridge shape crosswise to said conveying direction, said partial glaze having an asymmetrical contour in said conveying direction; and iii. plural heating elements, arranged on said partial glaze and in an array crosswise to said conveying direction, for applying pressure and heat to said recording material being conveyed, said heating elements being disposed upstream offset from a center of said partial glaze in said conveying direction.

38. A thermal printer comprising:

a conveyor for conveying a thermosensitive recording material in a predetermined conveying direction;

a thermal head for recording an image to said recording material, said thermal head including a base plate, a partial glaze disposed to project from said base plate in a ridge shape crosswise to said conveying direction, and plural heating elements, arranged on said partial glaze and in an array crosswise to said conveying direction, for applying pressure and heat to said recording material being conveyed, wherein said partial glaze has an asymmetrical contour in said conveying direction;

a platen member, disposed opposite to said thermal head, for supporting a back of said recording material pressed by said thermal head, wherein a roller center of said platen member is disposed upstream offset from a center of said partial glaze in said conveying direction.

39. A thermal printer, including a conveyor for conveying a thermosensitive recording material in a predetermined conveying direction, and a thermal head for recording an image to said recording material, said thermal head including:

a base plate;

a partial glaze disposed to project from said base plate in a ridge shape crosswise to said conveying direction;

plural heating elements, arranged on said partial glaze and in an array crosswise to said conveying direction, for applying heat to said recording material being conveyed;

a heating surface, disposed on said partial glaze and on an outside of said heating elements, pressed against said recording material, for conducting said heat to said recording material;

a rise surface, disposed on said partial glaze, and between said heating surface and an upstream distal end of said partial glaze with reference to said conveying direction, and at least partially curved at a first radius of curvature; and a cooling surface, disposed on said partial glaze and downstream adjacent to said heating surface in said conveying direction, pressed against said recording material, for cooling said recording material, wherein said cooling surface is flat or curved at a predetermined radius of curvature, said predetermined radius being greater than said first radius.

40. A thermal printer as defined in claim 39, wherein said cooling surface is so extended that a center of said partial glaze is located within a range of said cooling surface.

* * * * *